US011878208B1

(12) United States Patent
Drumheller

(10) Patent No.: US 11,878,208 B1
(45) **Date of Patent: *Jan. 23, 2024**

(54) EXERCISE SYSTEMS AND METHODS

(71) Applicant: Garrett Glenn Drumheller, Elverson, PA (US)

(72) Inventor: Garrett Glenn Drumheller, Elverson, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/377,082

(22) Filed: Oct. 5, 2023

Related U.S. Application Data

(63) Continuation of application No. 18/082,389, filed on Dec. 15, 2022, now Pat. No. 11,779,798.

(60) Provisional application No. 63/346,773, filed on May 27, 2022, provisional application No. 63/293,214, filed on Dec. 23, 2021.

(51) Int. Cl.
*A63B 21/00* (2006.01)
*A63B 23/035* (2006.01)
*A63B 23/04* (2006.01)

(52) U.S. Cl.
CPC .... *A63B 21/4034* (2015.10); *A63B 21/00047* (2013.01); *A63B 23/03525* (2013.01); *A63B 23/0494* (2013.01)

(58) Field of Classification Search
CPC ..... A63B 21/1654; A63B 21/0442; A63B 21/0555; A63B 21/1609; A63B 21/1618–1663; A63B 21/055–0557; A63B 21/068; A63B 21/16–169; A63B 21/4033–4035; Y10T 403/54; B65H 16/005; B65H 16/02; B65H 16/023; B65H 16/028; B65H 18/02; B65H 18/023; B65H 18/06; B65H 18/08; B65H 18/28; B65H 54/02; B65H 2405/40; B65H 2405/45; B65H 2405/451; B65H 2405/4521; B65H 75/28
USPC ..... 256/40, 45; 242/587, 587.2
See application file for complete search history.

(56) References Cited

U.S. PATENT DOCUMENTS

| | | | | |
|---|---|---|---|---|
| 3,129,940 A * | 4/1964 | Lauro | A63B 21/28 482/92 |
| 4,591,150 A | 5/1986 | Mosher | |
| 4,602,782 A | 7/1986 | Carlson | |
| 4,653,747 A | 3/1987 | Newcomer | |
| 4,679,788 A | 7/1987 | Adler | |
| 4,793,609 A * | 12/1988 | Coutts | A63B 21/0552 482/122 |
| 4,909,505 A | 3/1990 | Tee | |

(Continued)

FOREIGN PATENT DOCUMENTS

| | | |
|---|---|---|
| FR | 2844458 A1 | 3/2004 |
| IE | 20210053 A2 | 9/2022 |

OTHER PUBLICATIONS

NordStickAmazon (derived from: Amazon, "NordStick Nordic and PRO Hamstring Curl Strap . . . " [online], Jun. 23, 2021 [retrieved on Apr. 22, 2023], Retrieved from: https://www.amazon.com/NordStick-Nordic-Hamstring-Curl-Strap/dp/B097S8MBLM?th=1) (Year:2021).

*Primary Examiner* — Megan Anderson
*Assistant Examiner* — Catrina A Letterman
(74) *Attorney, Agent, or Firm* — Acuity IP, LLC; Nathan S. Cassell

(57) ABSTRACT

A workout device that allows for at home Nordic hamstring curls using a. doorframe or other immovable object is disclosed.

5 Claims, 28 Drawing Sheets

(56) References Cited

U.S. PATENT DOCUMENTS

| | | | | |
|---|---|---|---|---|
| 5,137,503 | A * | 8/1992 | Yeh | A63B 23/12 482/125 |
| 5,163,889 | A | 11/1992 | Kaaua | |
| 5,372,566 | A * | 12/1994 | Olschansky | A63B 23/0211 482/91 |
| 5,558,609 | A * | 9/1996 | Olschansky | A63B 21/4015 482/125 |
| 5,626,549 | A | 5/1997 | Olschansky et al. | |
| 5,672,144 | A * | 9/1997 | Hulme | A63B 23/0211 482/91 |
| 6,099,437 | A * | 8/2000 | DeMers | A63B 21/153 482/46 |
| 8,641,586 | B2 * | 2/2014 | Bremer | A63B 23/0211 482/121 |
| 9,775,764 | B1 * | 10/2017 | Rill | A61H 1/0266 |
| 2005/0070406 | A1 * | 3/2005 | Delp | A63B 23/0211 482/91 |
| 2005/0170937 | A1 | 8/2005 | Van Straaten | |
| 2005/0239617 | A1 | 10/2005 | Tenaglia | |
| 2007/0173387 | A1 * | 7/2007 | Wu | A63B 21/169 482/121 |
| 2007/0225134 | A1 | 9/2007 | Slattery | |
| 2009/0192022 | A1 * | 7/2009 | Kulka | A63B 21/153 482/46 |
| 2012/0115693 | A1 * | 5/2012 | Franques | A63B 23/0211 482/140 |
| 2012/0245004 | A1 * | 9/2012 | Bremer | A63B 23/14 482/129 |
| 2017/0014681 | A1 | 1/2017 | Doherty | |
| 2018/0071576 | A1 * | 3/2018 | Seltzer | A63B 23/03516 |
| 2018/0318631 | A1 * | 11/2018 | Siu | A63B 21/0442 |
| 2022/0152441 | A1 * | 5/2022 | Karnes, Jr. | A63B 21/00043 |
| 2023/0201653 | A1 | 6/2023 | Drumheller | |

* cited by examiner

EXERCISE SYSTEMS AND METHODS

CROSS-REFERENCES TO RELATED APPLICATIONS

This application is a continuation of U.S. patent application Ser. No. 18/082,389 filed Dec. 15, 2022, which claims the benefit of U.S. Provisional Patent Application Nos. 63/293,214 filed Dec. 23, 2021 and 63/346,773 filed May 27, 2022. The disclosure of each of the above listed applications is incorporated herein by reference.

BACKGROUND OF THE INVENTION

Embodiments of the present invention relate to the field of exercise systems and methods, and in particular embodiments, to workout devices and methods that allow for at home Nordic hamstring curls using a doorframe.

Embodiments of the present invention enable the user to do Nordic hamstring curls anywhere there is a doorframe. Such solutions enable people to exercise their hamstrings and other muscles when they are not able to access a gym. Other existing machines that allow for hamstring curls are expensive and bulky. Embodiments of the present invention replace a bulky and expensive machine with a compact, portable, and inexpensive alternative. Embodiments of the present invention provide solutions to various outstanding needs.

BRIEF SUMMARY OF THE INVENTION

Embodiments of the present invention include exercise systems and methods.

Embodiments of the present invention allow users to target specific muscle groups typically neglected during at home workouts. This is a compact and cheaper alternative to the popular glute hamstring developer (GHD) machine most gyms have. These current machines are at gyms; however, they are not obtainable by someone who cannot access a gym.

Prior to the development of embodiments of the present invention, there was not an effective way to do at home Nordic hamstring curls in the manner described herein. Exemplary embodiments use a foam base to be sturdy and fit in almost every doorway. Exemplary embodiments can also employ the use of wide straps (e.g. 2 inches in width), for enhanced stability.

In one aspect, embodiments of the present invention encompass exercise systems that include a 17-inch adjustable Nylon strap, a 13.5-inch steel bar, a 3-inch diameter by 5-inch foam cylinders, and a 1-inch diameter by 3-inch door anchor.

Advantageously, embodiments of the present invention provide the user with a system that is stable and can be used with speed and comfort. The user can stay focused on performing exercise repetitions, and the device can help to keep the user's face off or away from the floor. Exemplary embodiments include a 1.5" rubberized door anchor to keep the user focused and off the floor, with an ultra-thick comfort pad that will not dig into the user's legs. Set up of the system can be completed in 10 seconds or less. The system can include a hamstring curl strap that adjusts to the shoe size of the user. A belt strap can slip under the door and connects to work like a weight to keep the user's feet on the floor. Any of a variety of persons can use the device, including without limitation athletes, runners and lifters.

System embodiments disclosed herein can enable the user to exercise safely and correctly perform repetitions across the highest results driving exercises, including without limitation sit-ups, core training, razor curls, Spanish squats, core twists, and more. Embodiments disclosed herein can be used as a piece of home gym equipment or as a piece of travel fitness equipment. Embodiments produce powerful and rapid exercise benefits and results for users.

Embodiments disclosed herein can work through the knee flexion with little to no unwanted movement, thus promoting even faster sprint speed, hamstring hypertrophy, eccentric strength, injury reduction, and the like.

In an exemplary aspect, embodiments encompass exercise systems that include a user engagement assembly, an anchor assembly, and a strap assembly. A user engagement assembly can include a sleeve mechanism, a first compressible pad, a second compressible pad, a first end cap, a second end cap, and a central elongate element. A strap assembly can include a first end portion engaged with the sleeve mechanism and a second end portion engaged with the anchor assembly.

In another aspect, embodiments of the present invention encompass exercise systems that include a user engagement system, an anchor assembly, and a strap assembly. A user engagement assembly can include a central elongate element, a first compressible pad, a second compressible pad, a first end cap, a second end cap, and a sleeve mechanism. A strap assembly can include a first end portion engaged with the sleeve mechanism and a second end portion engaged with the anchor assembly. The central elongate element can include a first portion and a second portion. The first end cap can be engaged with a first end of the central elongate element and the second end cap can be engaged with a second end of the central elongate element. The sleeve mechanism can include (i) a first end portion having a first lateral rib, a first medial rib, and a first groove between the first lateral rib and the first medial rib, (ii) a second end portion having a second lateral rib, a second medial rib, and a second groove between the second lateral rib and the second medial rib, (iii) a central column disposed between the first medial rib and the second medial rib, (iv) a strap band extending between the first medial rib and the second medial rib, (v) a first guide disposed between the strap band and the central column and medial to the first medial rib, and (vi) a second guide disposed between the strap band and the central column and medial to the second medial rib. In some cases, the strap band, the central column, the first guide, and the second guide in combination define a slit that receives a strap of the strap assembly therethrough. In some cases, the first compressible pad is engaged with the first portion of the central elongate element and the second compressible pad is engaged with the second portion of the central elongate element. In some cases, a medial end portion of the first compressible pad includes an annular recess having a diameter that is equal to a diameter of the first lateral rib of the sleeve mechanism. In some cases, a medial end portion of the first compressible pad includes an annular recess having a diameter that is equal to a diameter of the first lateral rib of the sleeve mechanism. In some embodiments, a lateral end portion of the first compressible pad includes a recessed portion having a height, the first end cap includes a stem having a height, and the height of the recessed portion of the first compressible pad is equal to the height of the stem of the first end cap. In some embodiments, a lateral end portion of the first compressible pad includes a lateral internal groove, and an outer periphery of a cover of the first cap is nestled in the lateral internal groove of the first compressible pad. In some embodiments, a depth of the annular recess of the medial end portion of the first compressible pad is equivalent to a thickness of the first lateral rib of the first end portion of the sleeve mechanism. In some embodiments, a depth of the annular recess of the medial end portion of the second compressible pad is equivalent to a thickness of the second lateral rib of the second end portion of the sleeve mechanism.

DETAILED DESCRIPTION OF THE INVENTION

All illustrations of the drawings are to be describing selected embodiments of the present invention and are not intended to limit the scope of the present invention. All references of user or users pertain to either individual or individuals who would utilize embodiments of the present invention.

Exemplary embodiments of the present invention encompass exercise systems that include an adjustable strap, a bar, foam cylinders, and a door anchor.

In operation, the door anchor can be used by sliding it under a door frame to anchor the product. The strap attaches to the door anchor at the center of the anchor. The strap then attaches to the bar also at the center. The foam cylinders attach to both ends of the bar for comfort when user slides their legs behind the bar.

The product can anchor to any door frame, and with this anchor it allows the user to gain the leverage required to do Nordic hamstring curls. The door anchor provides a sturdy base, while the nylon strap and steel rod provide a place for the user to insert their legs and gain that leverage. This product uses the leverage from the door frame to target the hamstring muscle, while allowing for a variety of workouts that require leverage. The foam coverings provide the user with a comfortable experience, and allow for continued use.

Manufacture of the system can include assembling a steel rod with the foam supports on either end. The nylon strap can be used to connect the steel rod to the door anchor. The foam coverings can provide comfort.

According to some method embodiments, a person can slide the door anchor connected to the nylon strap under their door frame, then closing it. This person can ensure the plastic cylinder is keeping the strap in place and face away from the door, inserting their feet behind the foam shaft. The foam shaft can be wedged against their Achilles while they would be facing away from the door. The person can use the leverage this foam shaft provides to slowly lower them self, thus activating their hamstring. This would be repeated for a hamstring workout and is called the Nordic hamstring curl.

Figure 1:
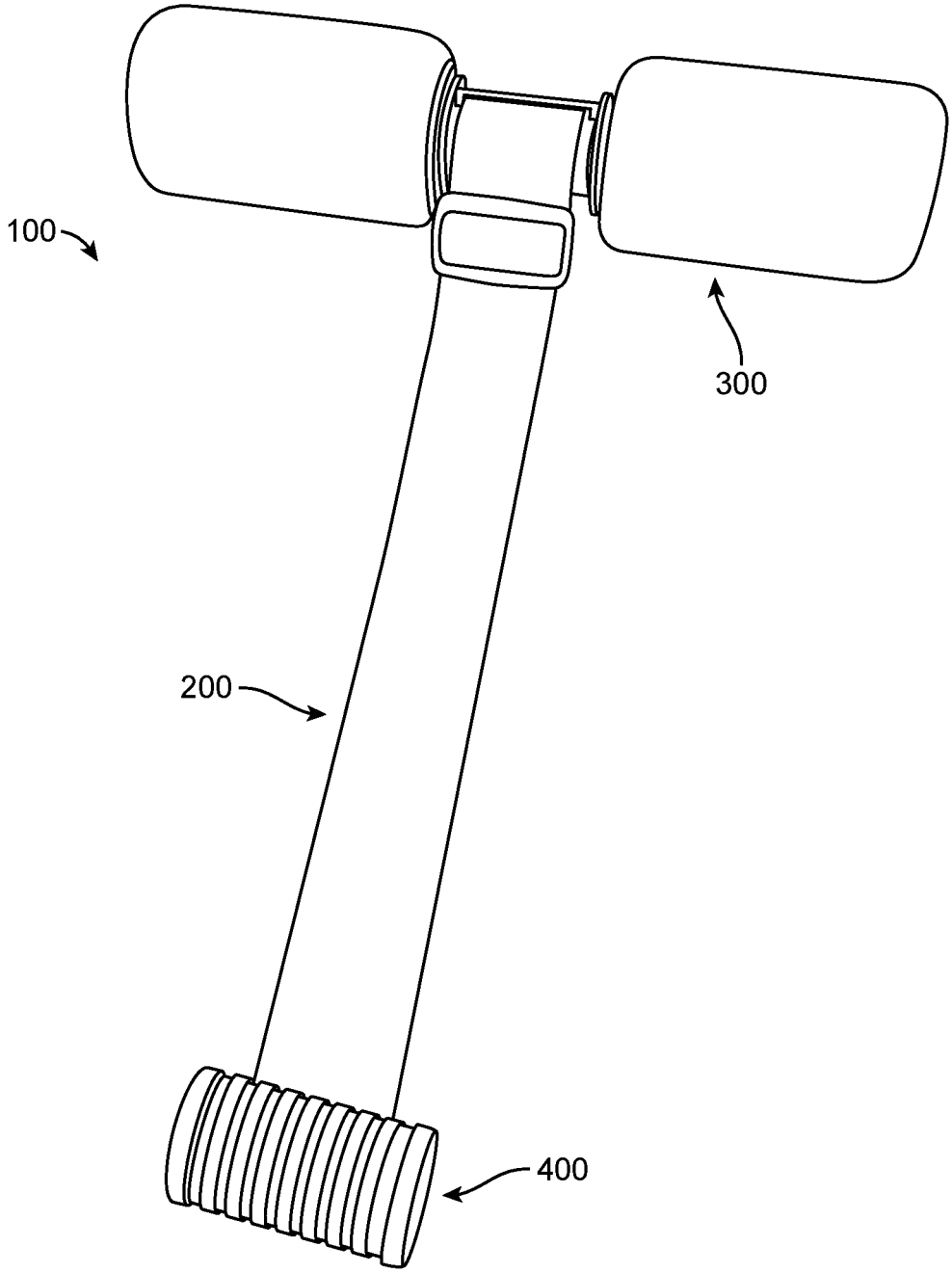
FIG. 1 illustrates aspects of an exercise system, according to embodiments of the present invention.

Turning now to the drawings, FIG. 1 depicts aspects of an exercise system 100 according to embodiments of the present invention. As shown here, an exercise system 100 can include a strap assembly 200, a user engagement assembly 300, and an anchor assembly 400. In some cases, a strap assembly can include or be provided as an adjustable strap. In some cases, a user engagement assembly can include or be provided as a bar and/or one or more foam cylinders. In some cases, an anchor assembly can include or be provided as a door anchor. In some cases, an anchor assembly can include a rubber cylinder or rod. In some cases, the rod or cylinder can include a plastic material. In some cases, the rod or cylinder can include a rubber material. The diameter of the cylinder or rod can be about 1.5 inches, in some embodiments.

Figure 2A:
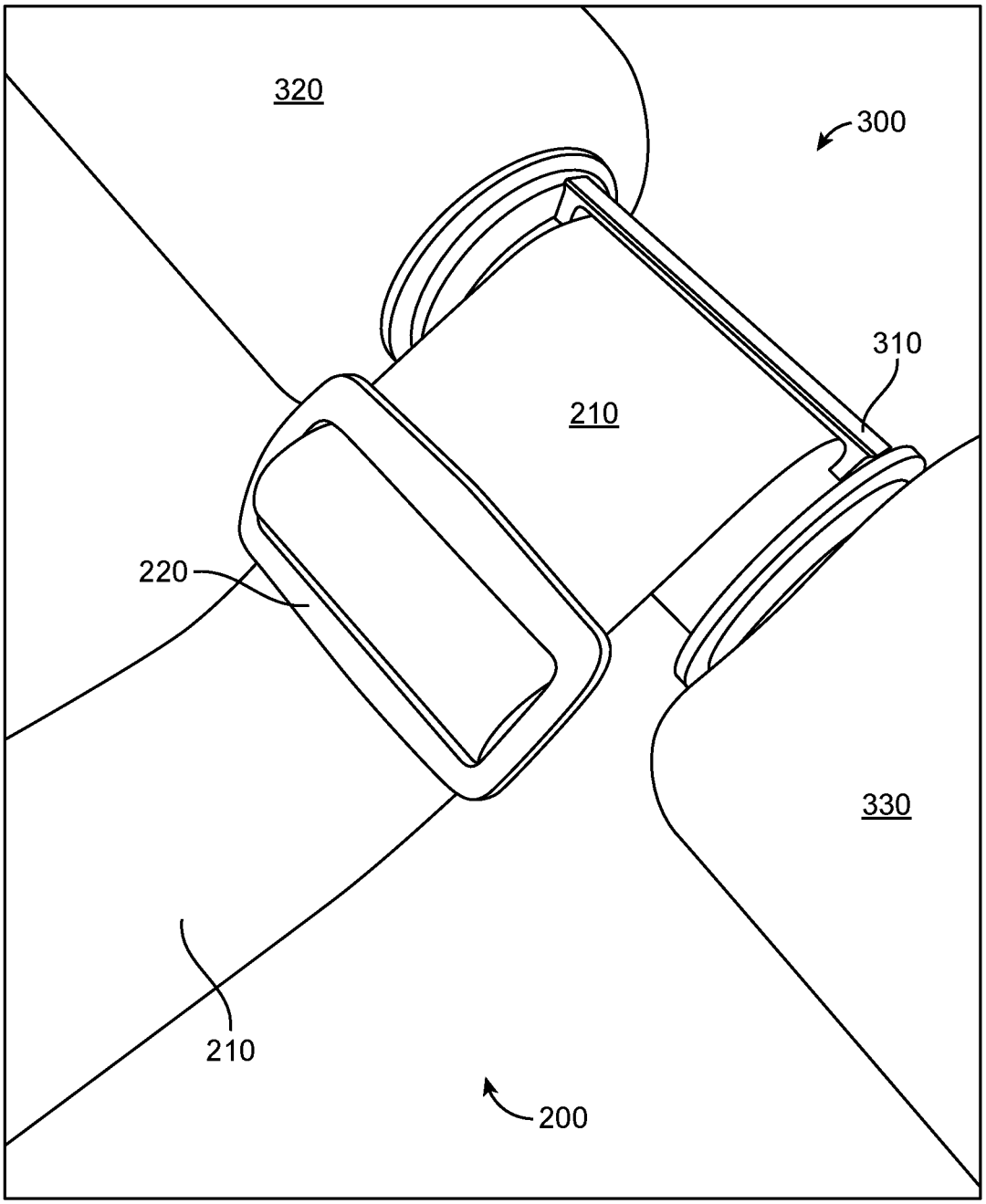
FIGS. 2A to 2C illustrates aspects of an exercise system, according to embodiments of the present invention.

As shown in FIG. 2A, a user engagement assembly 300 can include a sleeve mechanism 310, a first compressible pad 320, and a second compressible pad 330. Often, a compressible pad can be provided as a compressible cylinder or a foam cylinder. The foam cylinder can be about 1 inch thick, for example. Also as shown here, a strap assembly 200 can include a strap 210 and a buckle 220. The buckle can operate to provide the strap assembly with an adjustable functionality. As discussed elsewhere herein (e.g. with general reference to FIG. 3D), the sleeve mechanism 310 can include a strap band, central column, first guide, and second guide which in combination define a slit that receives the strap 210 of the strap assembly 200 therethrough. The first guide can prevent the strap 210 from contacting a first medial rib of the sleeve mechanism 310 and the second guide can prevent the strap 210 from contacting a second medial rib of the sleeve mechanism.

Figure 2C:
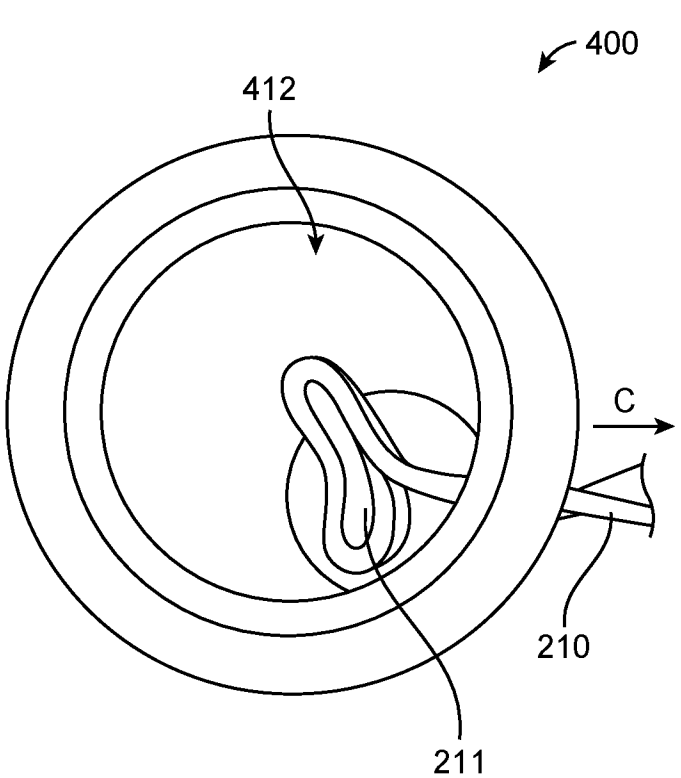
Figure 2B:
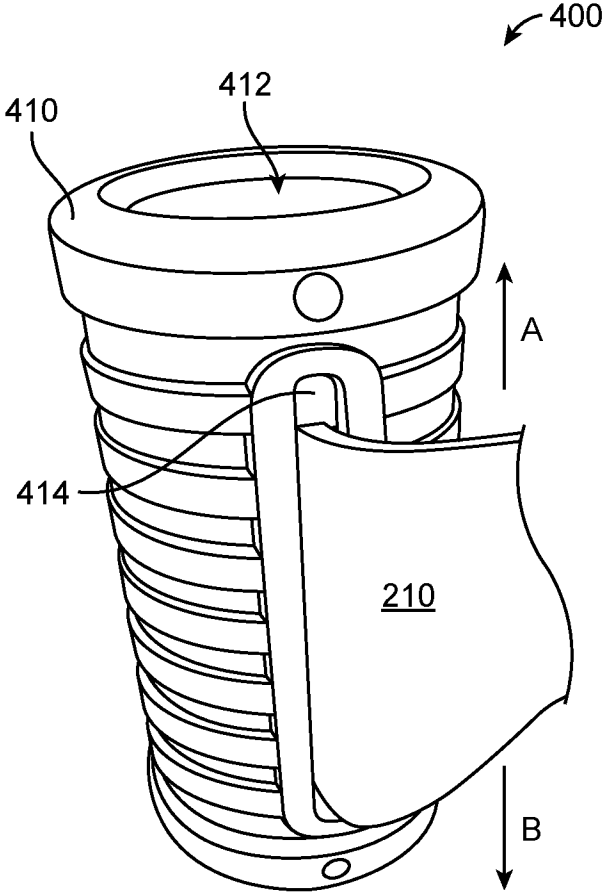

As shown in FIGS. 2B and 2C, an anchor assembly 400 can include an anchor cylinder or element 410 having an aperture 412 and a slot 414 that is configured to receive a strap 210 therethrough. In this way, when lateral forces are transmitted through or by the strap (e.g. as indicated by arrows A and B) the strap 210 remains fixed relative to the cylinder or element 410. The strap 210 includes a strap fastener 211 (e.g. folded portion of strap) which cannot be moved through the slot 410. In this way, when translational forces are transmitted through or by the strap (e.g. as indicated by arrow C) the strap 210 remains fixed relative to the cylinder or element 410.

Figure 3A:
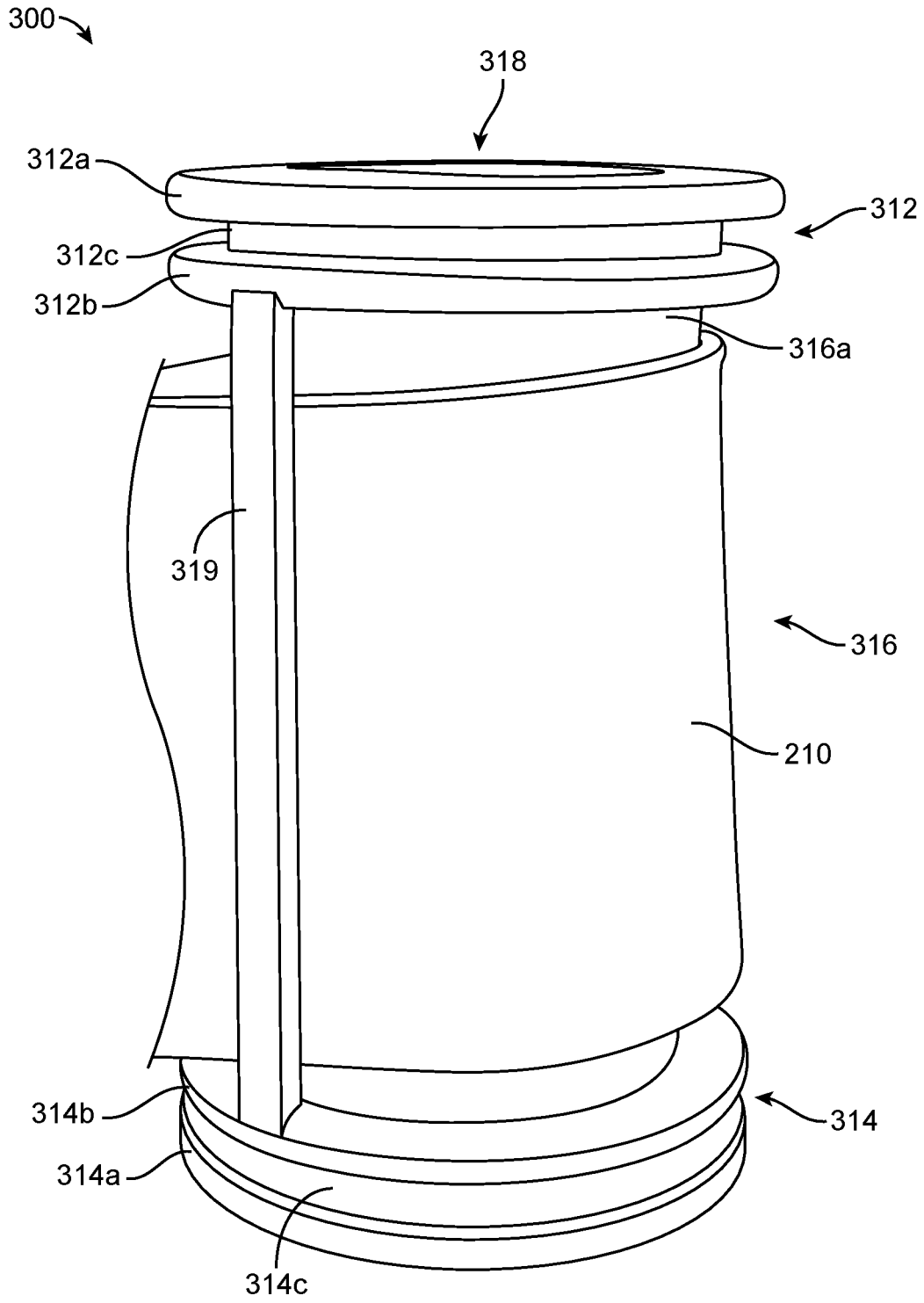
FIG. 3A illustrates aspects of an exercise system, according to embodiments of the present invention.

FIG. 3A illustrates various aspects of a sleeve mechanism 310. As depicted here, a sleeve mechanism 310 can include a first end portion 312, a second end portion 314, and a central portion 316 disposed therebetween. Sleeve mechanism 310 also includes a central aperture 318, and one or more strap bands 319. The first end portion 312 can include a first lateral rib 312*a* and a first medial rib 312*b* separated by a first groove 312*c*. The second end portion 314 can include a second lateral rib 314*a* and a second medial rib 314*b* separated by a second groove 314*c*. A groove as described here, which may also be referred to as a channel, can operate to provide space between a strap and a compression pad. For example, the compression pad can be positioned adjacent and lateral to lateral rib and the strap can be positioned adjacent and medial to a medial rib. Sleeve mechanism 310 also includes a central column 316*a*.

Figure 3B:
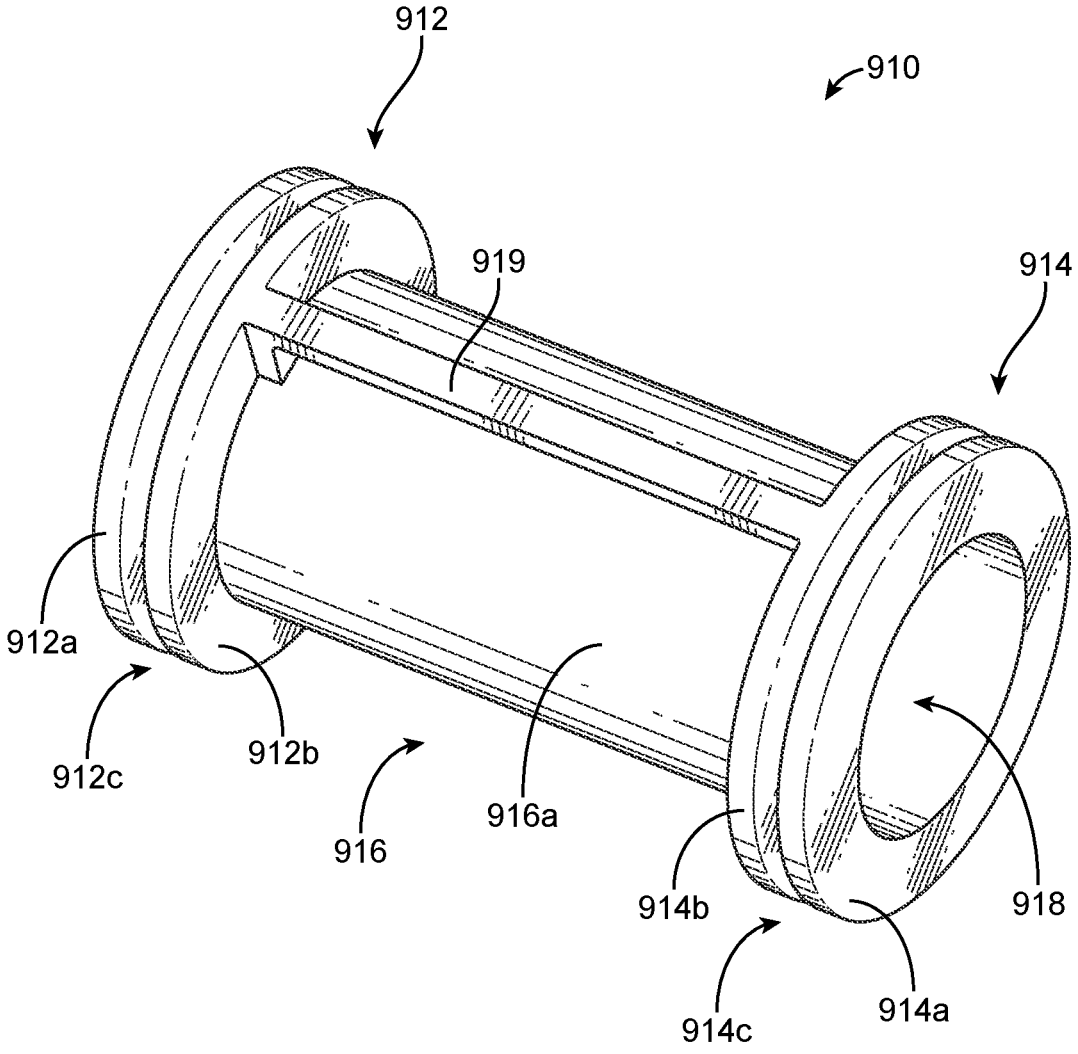
FIGS. 3B to 3H illustrate aspects of a sleeve mechanism of an exercise system, according to embodiments of the present invention.

FIG. 3B illustrates aspects of a sleeve mechanism 910, according to embodiments of the present invention. As depicted here, a sleeve mechanism 910 can include a first end portion 912, a second end portion 914, and a central portion 916 disposed therebetween. Sleeve mechanism 910 also includes a central aperture 918, and two strap bands 919. The first end portion 912 can include a first lateral rib 912*a* and a first medial rib 912*b* separated by a first groove 912*c*. The second end portion 914 can include a second lateral rib 914*a* and a second medial rib 914*b* separated by a second groove 914*c*. A groove as described here, which may also be referred to as a channel, can operate to provide space between a strap and a compression pad. For example, the compression pad can be positioned adjacent and lateral to lateral rib and the strap can be positioned adjacent and medial to a medial rib. Sleeve mechanism 910 also includes a central column 916*a*.

Figure 3C:
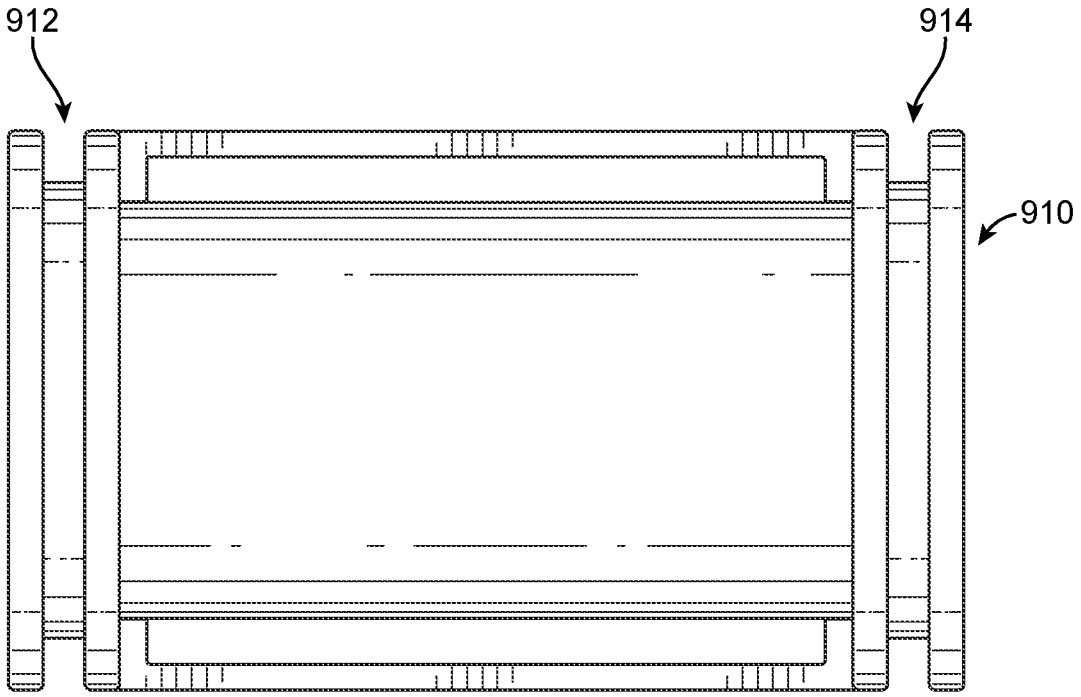
Figure 3D:
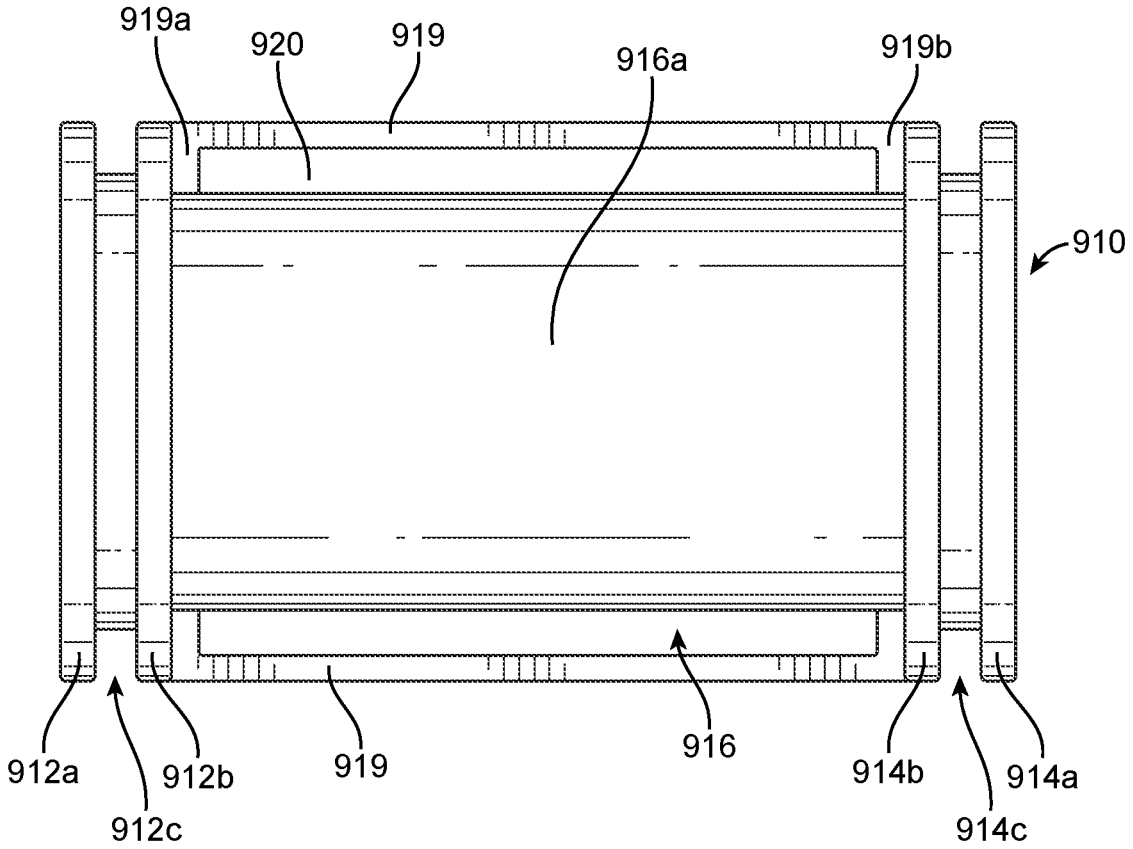

FIGS. 3C and 3D illustrate aspects of a sleeve mechanism 910, according to embodiments of the present invention. As depicted here, a sleeve mechanism 910 can include a first end portion 912, a second end portion 914, and a central portion 916 disposed therebetween. Sleeve mechanism 910 also includes a central aperture (not shown), and two strap bands 919. The first end portion 912 can include a first lateral rib 912*a* and a first medial rib 912*b* separated by a first groove 912*c*. The second end portion 914 can include a second lateral rib 914*a* and a second medial rib 914*b* separated by a second groove 914*c*. A groove as described here, which may also be referred to as a channel, can operate to provide space between a strap and a compression pad. For example, the compression pad can be positioned adjacent and lateral to lateral rib and the strap can be positioned adjacent and medial to a medial rib. Sleeve mechanism 910 also includes a central column 916*a*. Each strap band 919 includes a first guide 919*a* and a second guide 919*b*. First guide 919*a* is positioned adjacent and medial to first medial rib 912*b* and second guide 919*b* is positioned adjacent and medial to second medial rib 914*b*. Taken together, a strap band 919, the central column 916*a*, the first guide 919*a*, and the second guide 919*b* define a slit 920 that receives a strap (not shown) of a strap assembly therethrough. The first and second guides 919*a*, 919*b* can operate to prevent or inhibit the strap from contacting the first medial rib 912*b* and/or the second medial rib 914*b*.

Figure 3E:
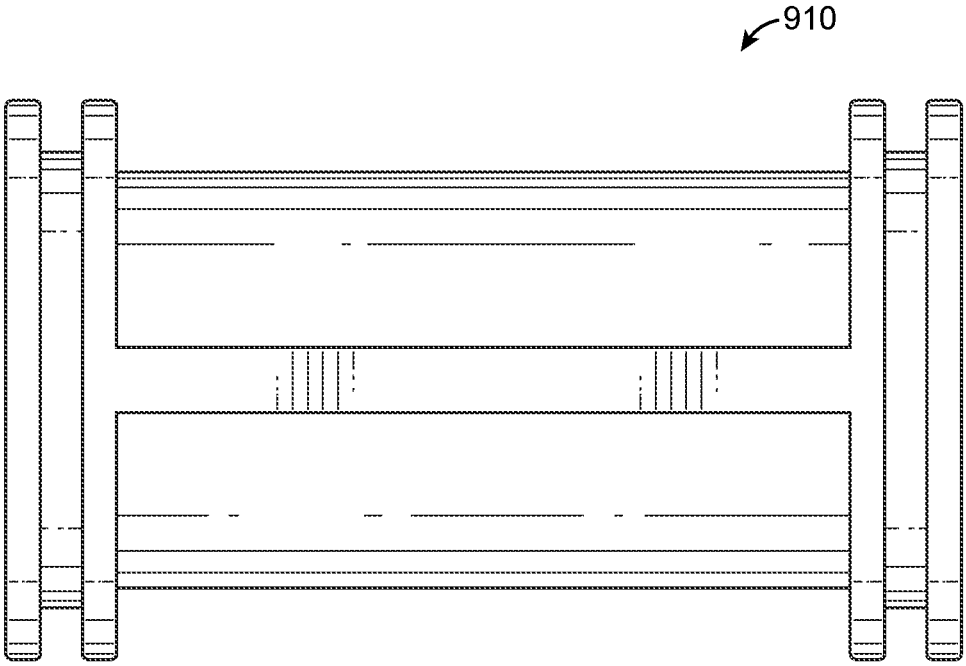
Figure 3F:
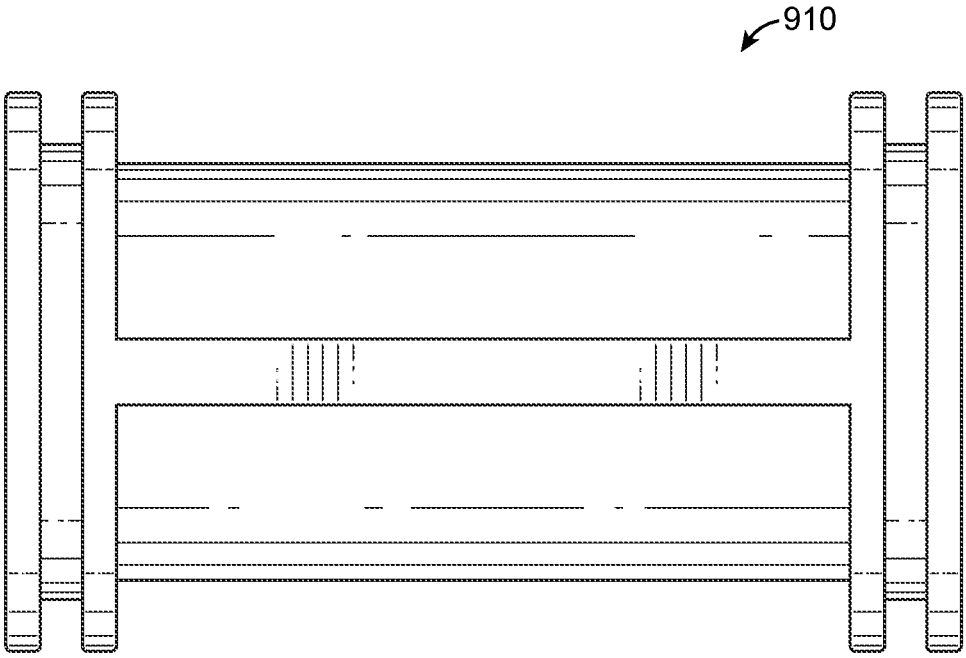
Figure 3G:
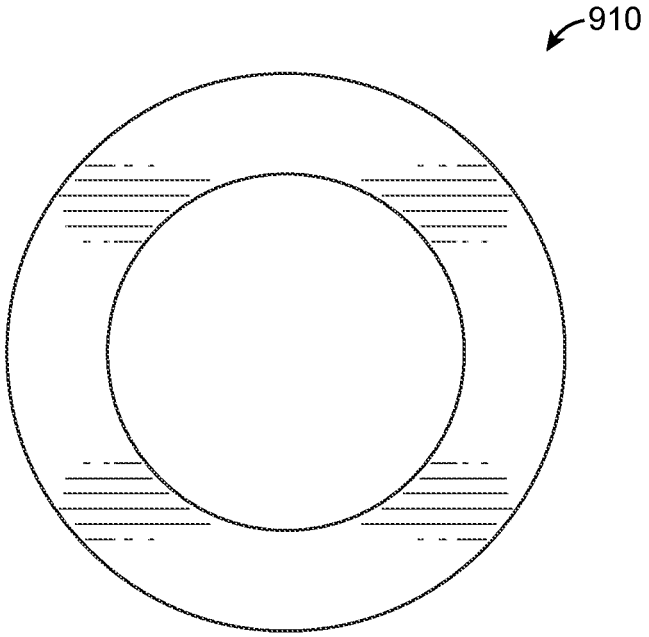
Figure 3H:
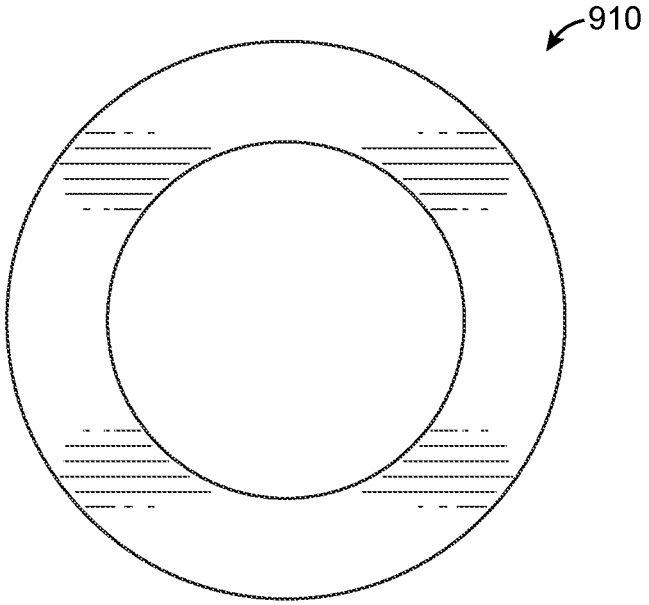

FIGS. 3B to 3H illustrate aspects of a sleeve mechanism 910 for an exercise system, according to embodiments of the present invention. FIG. 3B is a top perspective view of a sleeve mechanism showing a new design. FIG. 3C is a front elevation view of a sleeve mechanism showing a new design. FIG. 3D is a rear elevation view of a sleeve mechanism showing a new design. FIG. 3E is a right side elevation view of a sleeve mechanism showing a new design. FIG. 3F is a left side elevation view of a sleeve mechanism showing a new design. FIG. 3G is a top plan view of a sleeve mechanism showing a new design. FIG. 3H is a bottom plan view of a sleeve mechanism showing a new design.

According to some embodiments, the sleeve mechanism depicted in FIGS. 3B-3H is used with or is a component of an exercise system. According to some embodiments, the sleeve mechanism depicted in FIGS. 3B-3H engages with strap and/or one or more compression pads of an exercise system. According to some embodiments, the sleeve mechanism depicted in FIGS. 3B-3H engages with a central elongate element of an exercise system. According to some embodiments, the instant application discloses an ornamental design for a sleeve mechanism as shown in FIGS. 3B-3H. According to some embodiments, the instant application enables a claim for an ornamental design for a sleeve mechanism as shown in FIGS. 3B-3H. According to some embodiments, the instant application discloses an ornamental design for a sleeve mechanism for an exercise system as shown in FIGS. 3B-3H. According to some embodiments, the instant application enables a claim for an ornamental design for a sleeve mechanism for an exercise system as shown in FIGS. 3B-3H.

In some embodiments, FIGS. 3B-3H depict aspects of a design (e.g. an ornamental design) for a sleeve mechanism. Embodiments of the present invention encompass one or more ornamental designs or ornamental characteristics that are embodied in the sleeve mechanism depicted in FIGS. 3B-3H, and which may relate to the configuration or shape of the sleeve mechanism depicted in FIGS. 3B-3H. In some cases, the ornamental designs or characteristics may be embodied in the entire sleeve mechanism shown in FIGS. 3B-3H. In some cases, the ornamental designs or characteristics may be embodied in only a portion of or in certain features of the sleeve mechanism shown in FIGS. 3B-3H. The scope of the design is not defined or limited by the solid line structure depicted in FIGS. 3B-3H. Where the ornamental designs or characteristics are embodied in only a portion of or in certain features of the sleeve mechanism, it is understood that one or more portions of or certain features of the solid line structure depicted in FIGS. 3B-3H can be converted to or replaced with broken or dashed lines, whereby such broken or dashed lines may form no part of a claimed design, whereby such broken or dashed lines may represent a portion of the design that is unclaimed, and/or whereby such broken or dashed lines may include a portion of the sleeve mechanism in which the design is embodied, without resulting in a change in configuration of the design embodied in FIGS. 3B-3H. For example, but without limitation, it is understood that the first guide and/or the second guide of the design embodied in the sleeve mechanism depicted in FIGS. 3B-3H may be claimed separately from the remainder of the design. Embodiments of the present invention encompass one or more design claims directed to one or more subsets of the features or elements illustrated in FIGS. 3B-3H. Any broken or dashed lines present in FIGS. 3B-3H may be disclaimed portions of the sleeve mechanism as forming no part of a claimed design or a design to be patented. It is understood that one or more portions of or certain features of any broken or dashed lines depicted in FIGS. 3B-3H can be converted to or replaced with solid line structure, without resulting in a change in configuration of the design embodied in FIGS. 3B-3H.

Figure 4A:
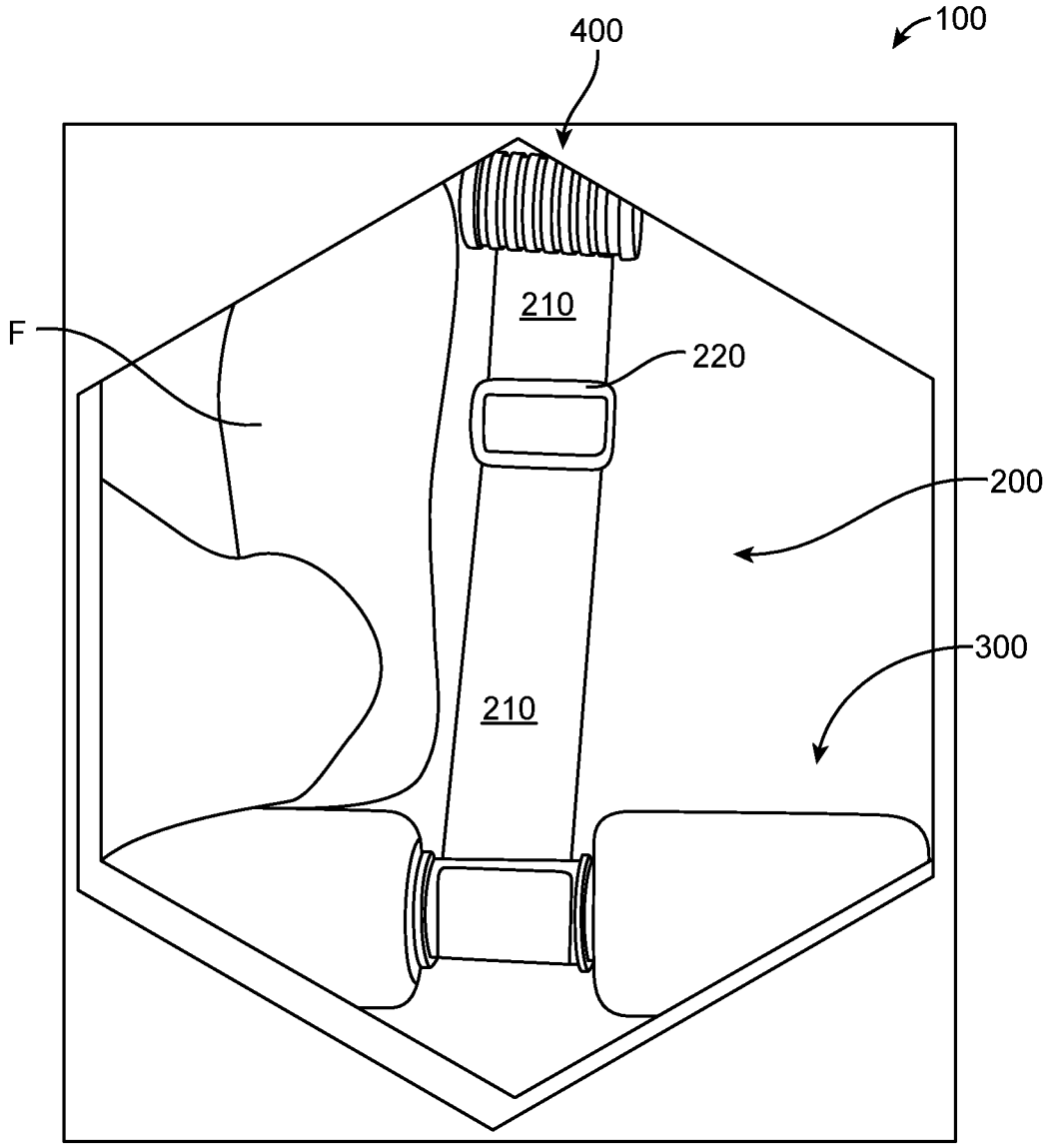
FIGS. 4A to 4G illustrate aspects of methods for using an exercise system, according to embodiments of the present invention.

FIGS. 4A to 4G depict aspects of methods of using an exercise system, according to embodiments of the present invention. As shown in FIG. 4A, the strap assembly 200 can be adjusted (e.g. by moving the buckle 220 and strap 210 relative to one another), so that a distance between the user engagement assembly 300 and the anchor assembly 400 is approximately equal to the length of the user's foot F.

Figure 4B:
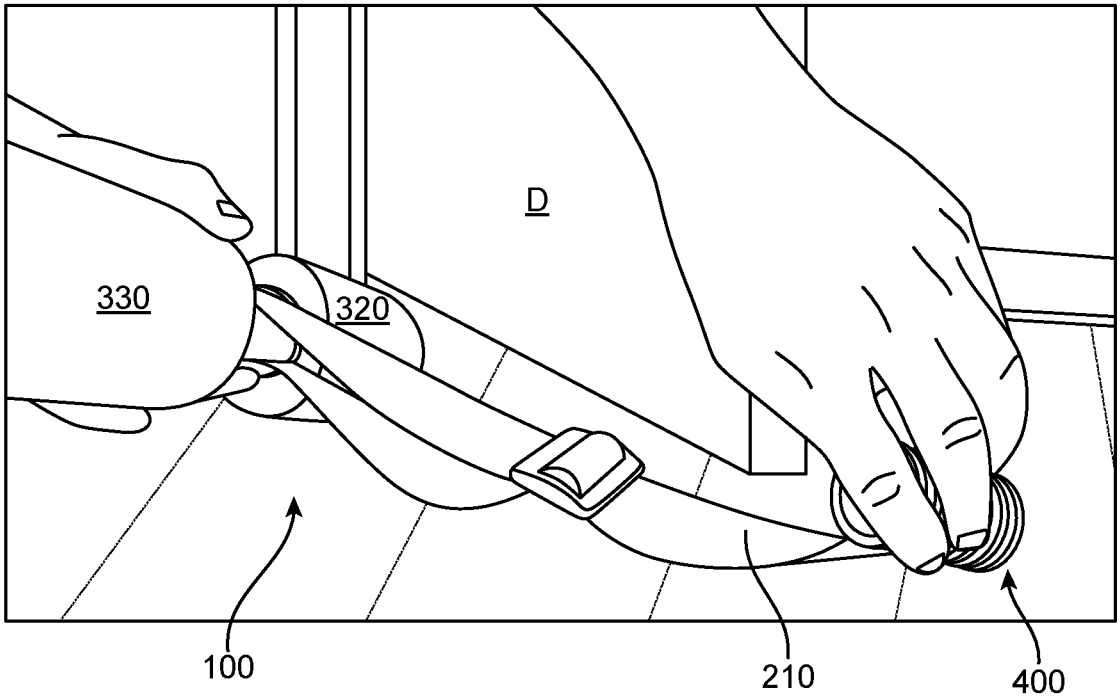
Figure 4C:
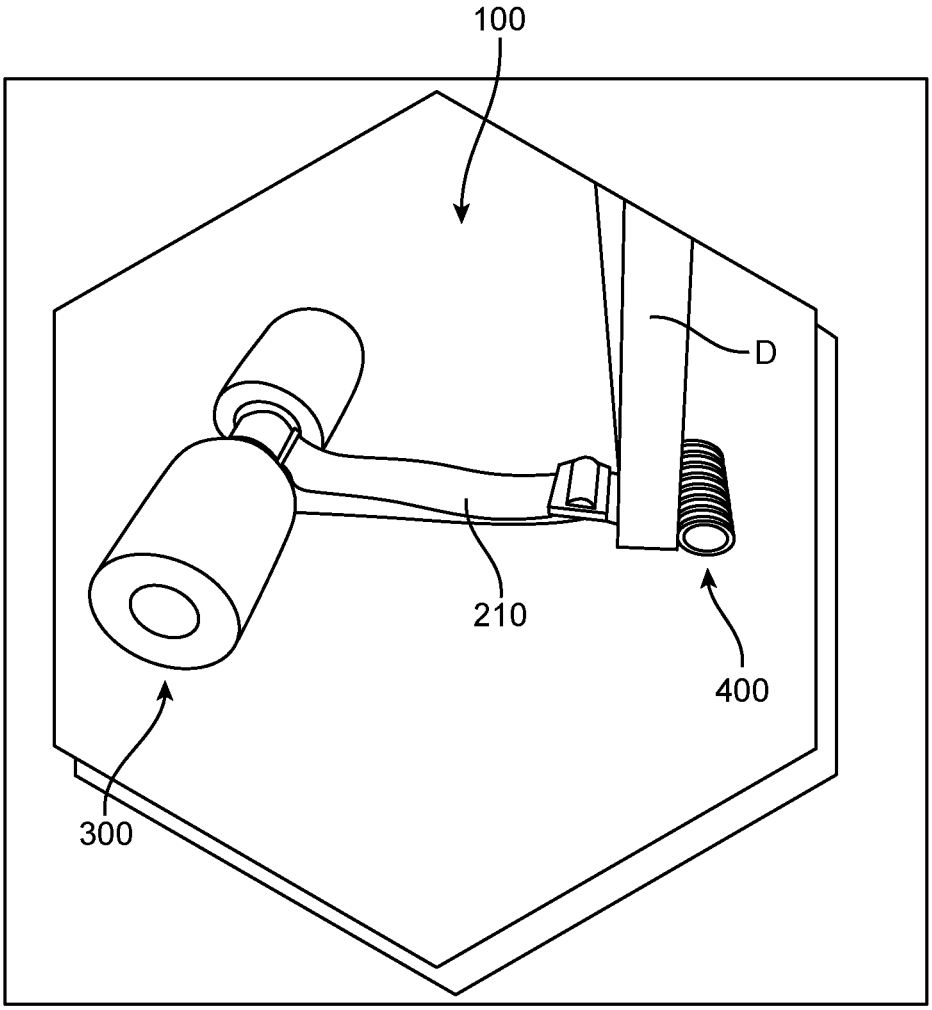
Figure 4D:
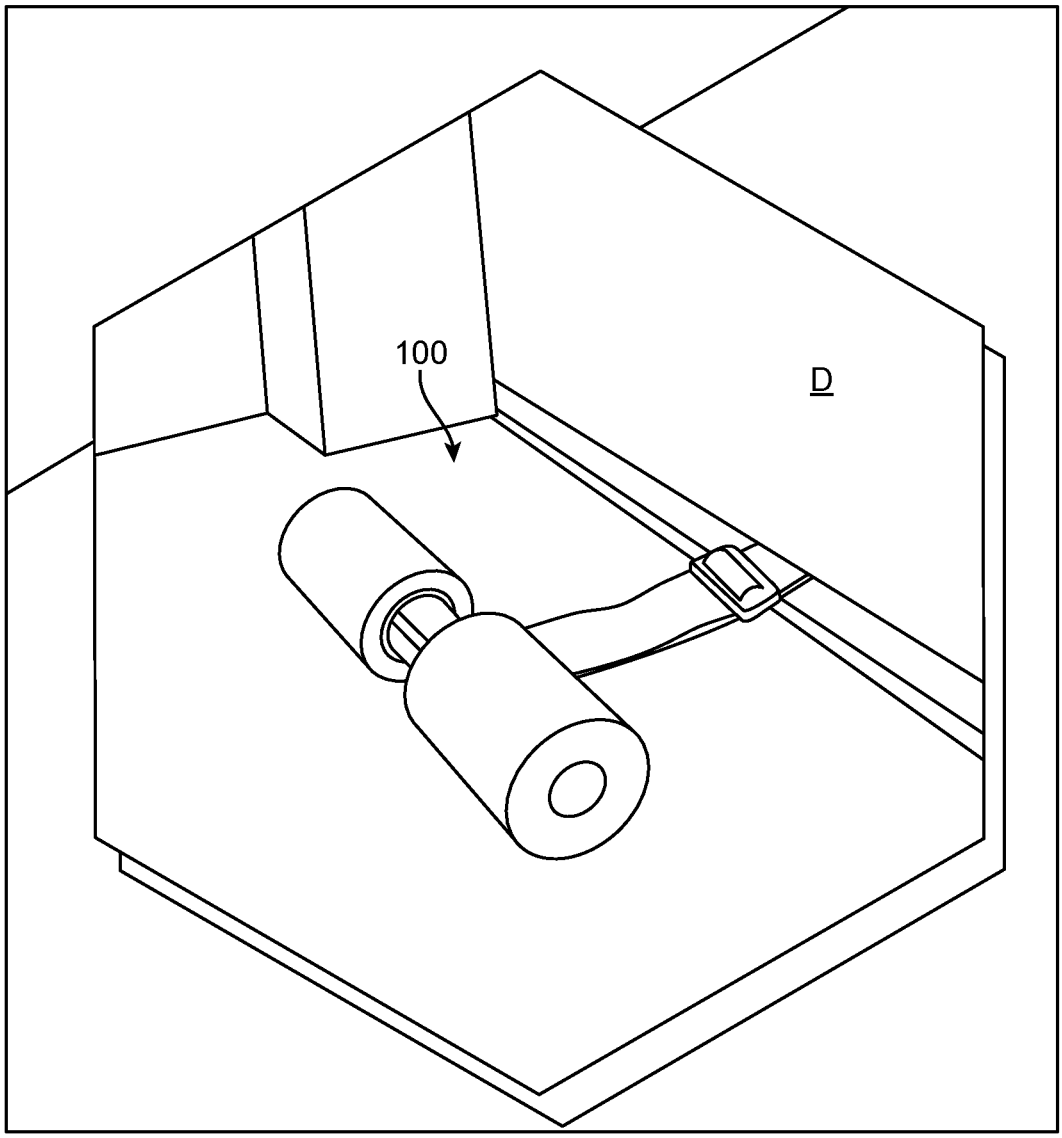
Figure 4E:
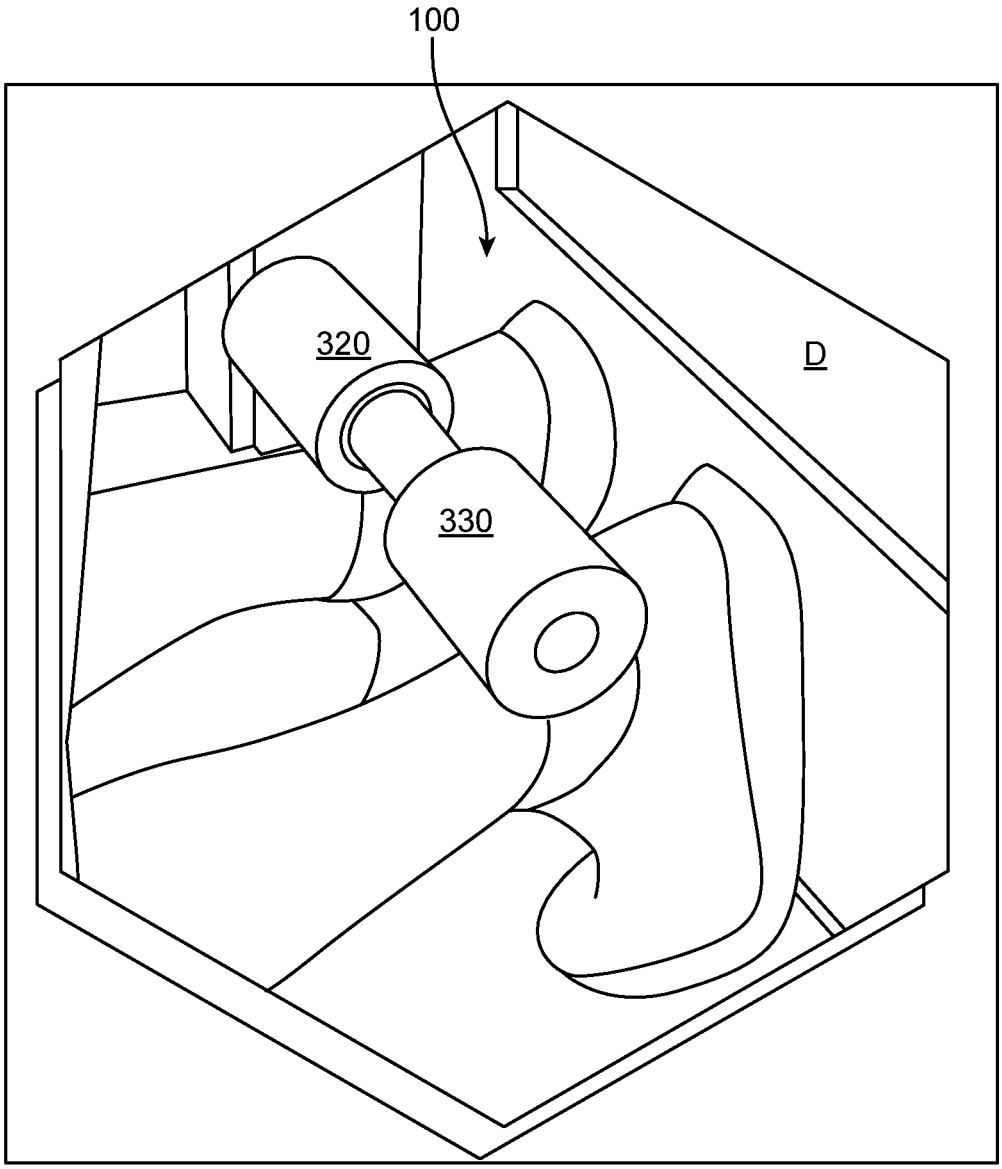
Figure 4F:
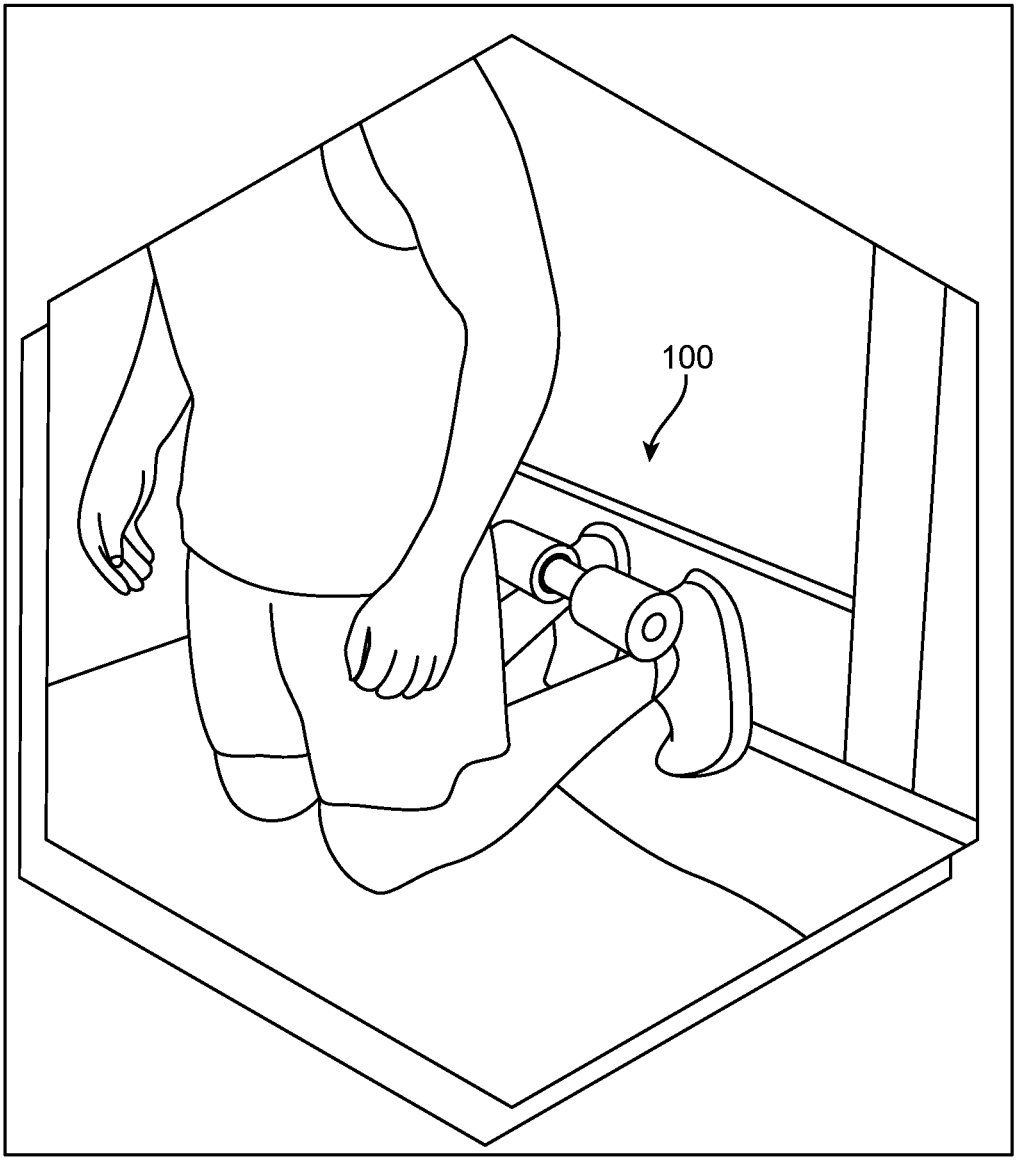
Figure 4G:
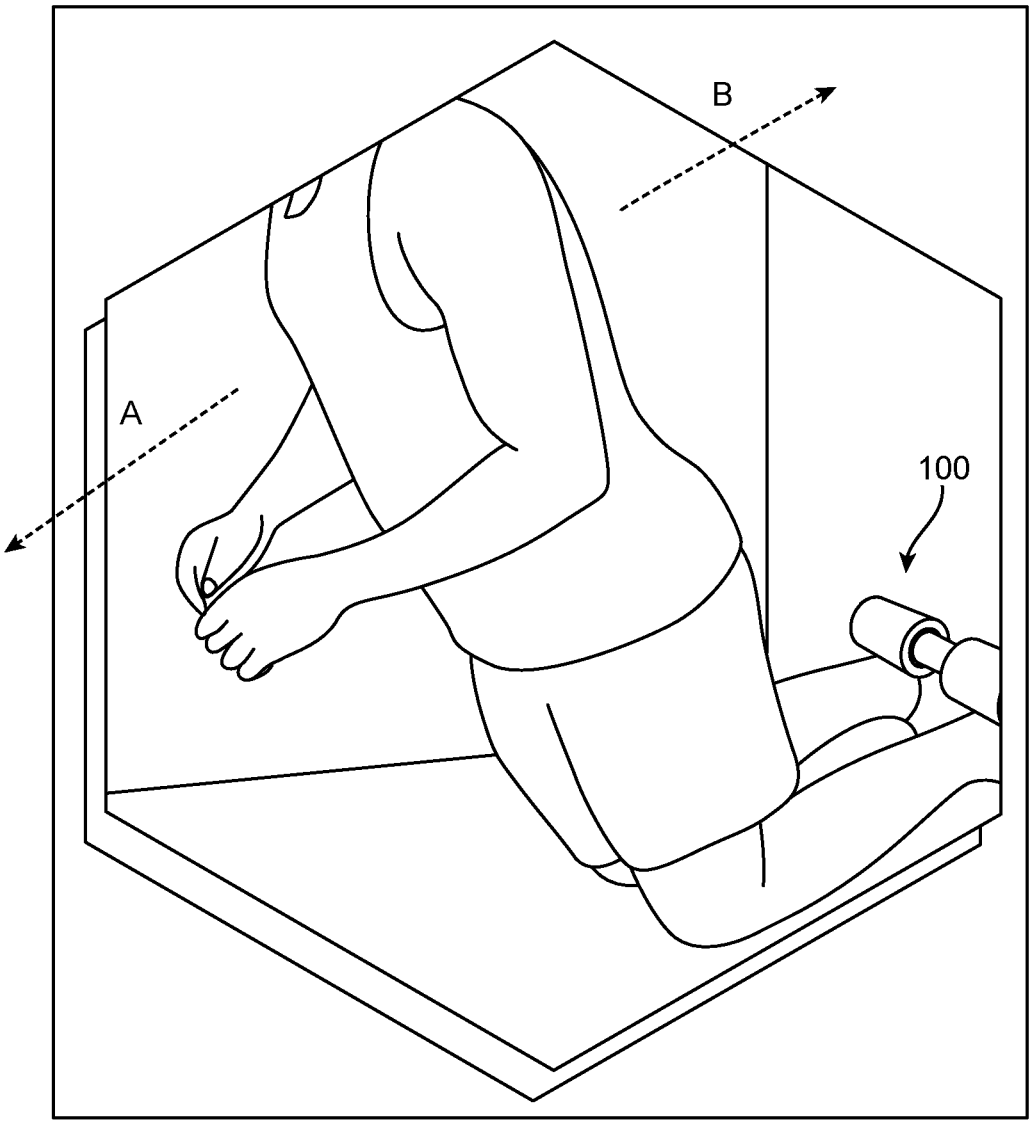

As shown in FIGS. 4B and 4C, the exercise system 100 can be engaged with a door D, for example so that the strap 210 is positioned beneath the bottom of the door D, and the anchor assembly 400 is adjacent to or in contact with the door D. As shown in FIG. 4D, the door D can be closed, for example so as to immobilize the door. As shown in FIG. 4E, the user can place the bottom or their feet or shoes against the door D, while the back of their lower legs (e.g. Achilles tendon) press against the compressible pads 320, 330. The user can then kneel on the floor on their knees as shown in FIG. 4F, and lean forward as shown in FIG. 4G. By leaning forward (e.g. as shown by arrow A) and returning back toward an upright position (e.g. as shown by arrow B) the user can perform one or more Nordic hamstring curl repetitions. In some cases, a user may wish to position a pad or cushion beneath their knees, between their knees and the floor. In some cases, a user may wish to secure the anchor assembly 400 with something other than a door, for example a bedframe, shelf, or other immovable or fixed object that remains stationary relative to the floor.

Figure 5:
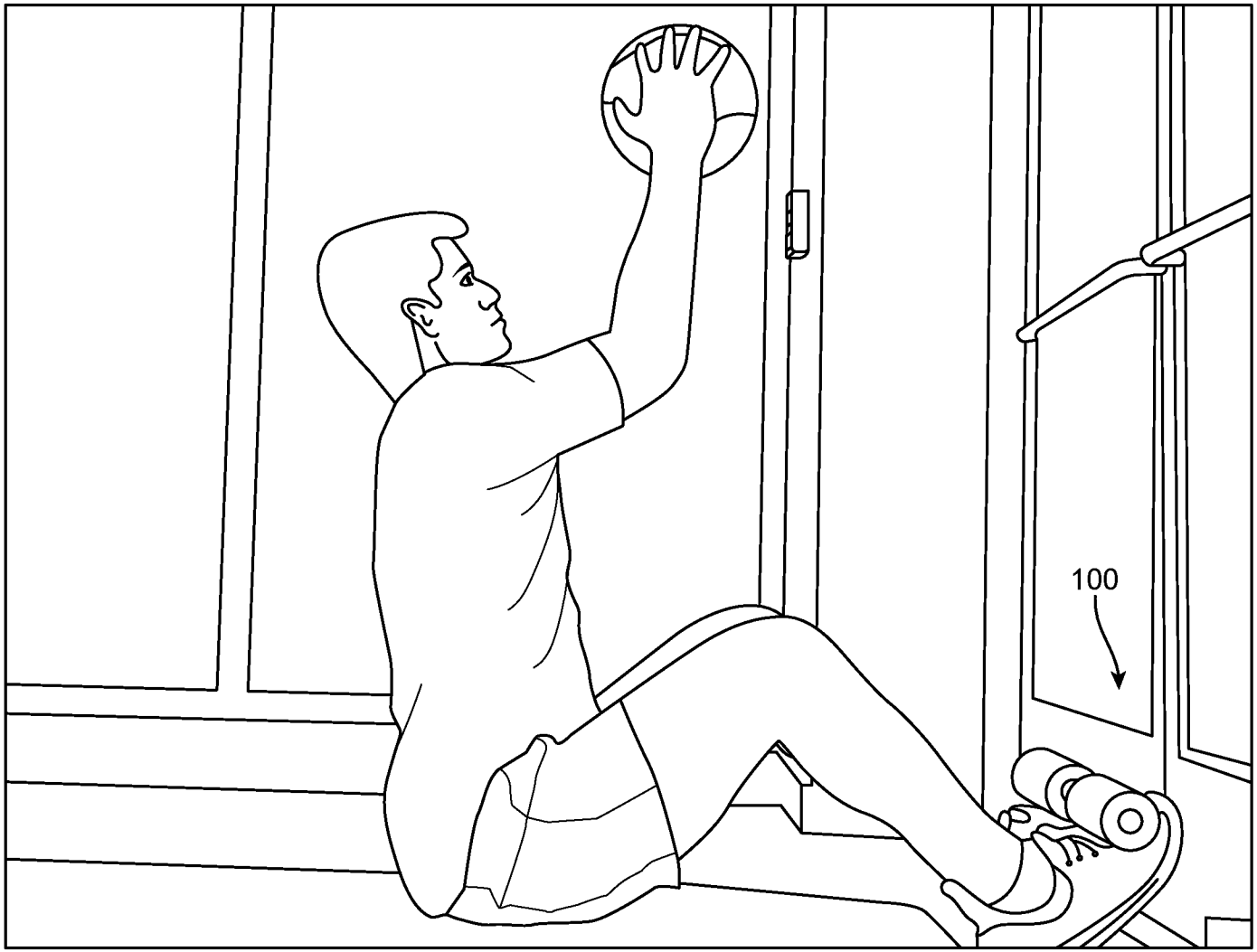
FIG. 5 illustrates aspects of a method for using an exercise system, according to embodiments of the present invention.
Figure 6:
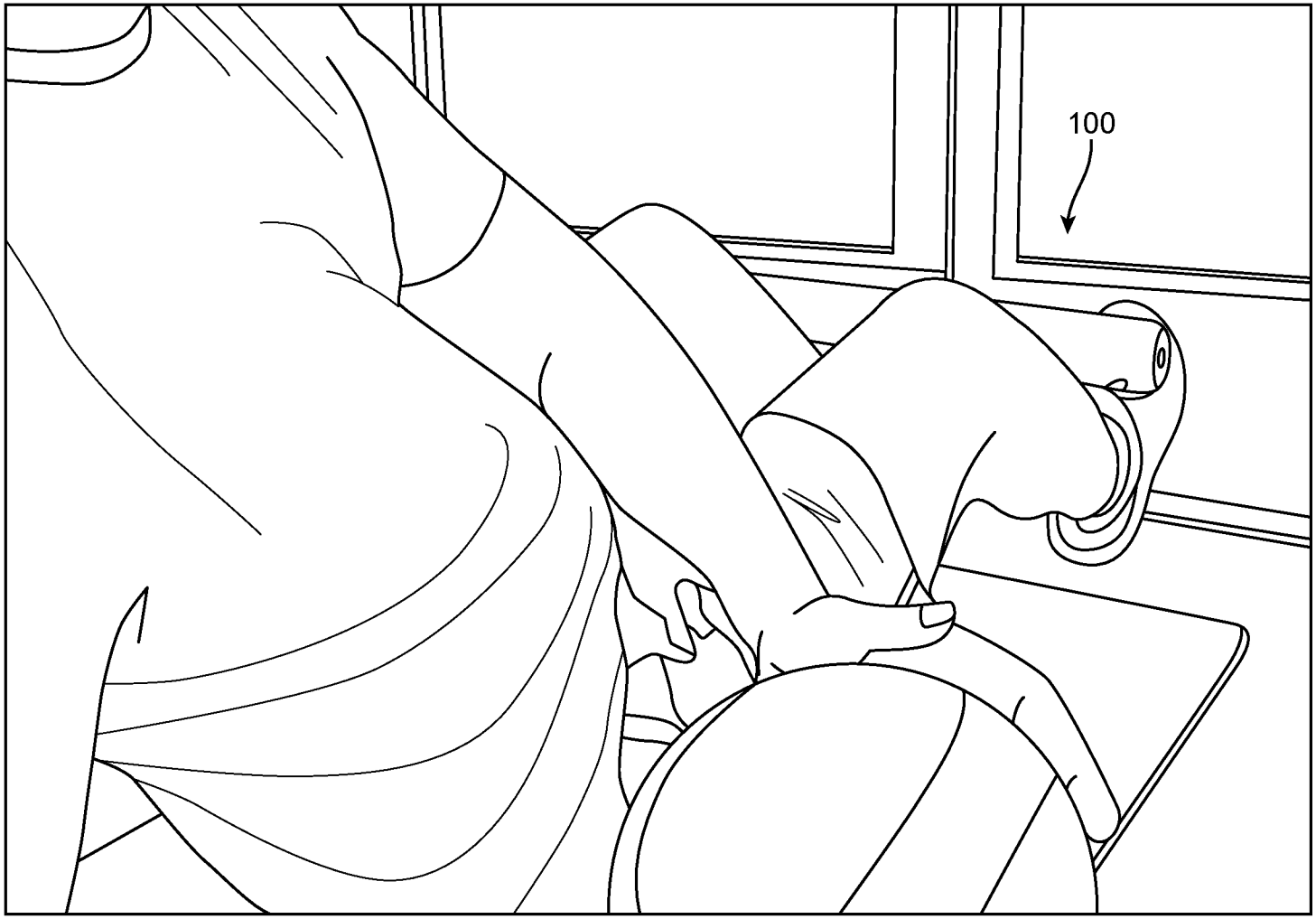
FIG. 6 illustrates aspects of a method for using an exercise system, according to embodiments of the present invention.
Figure 8:
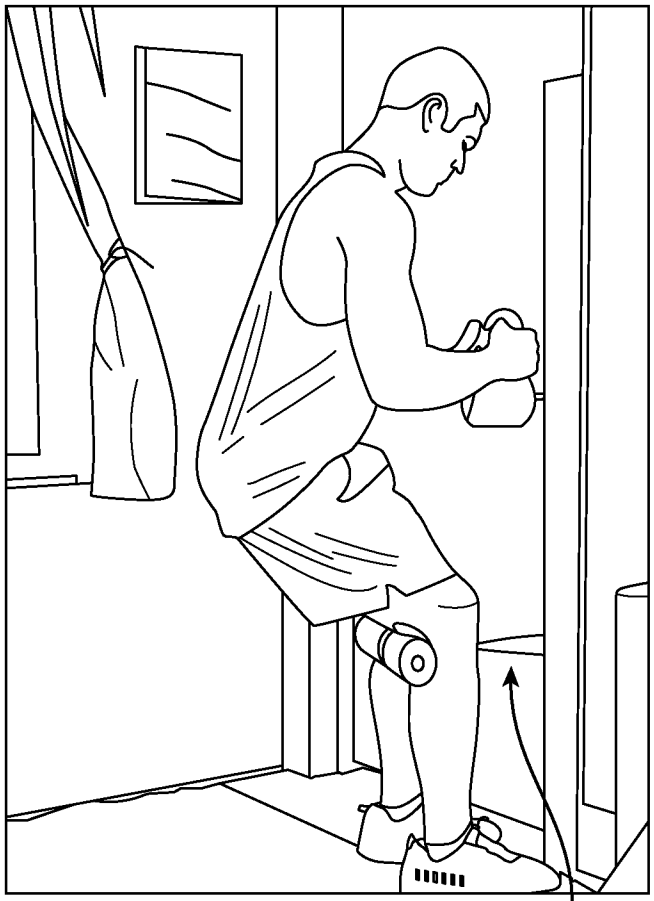
FIG. 8 illustrates aspects of a method for using an exercise system, according to embodiments of the present invention.
Figure 7:
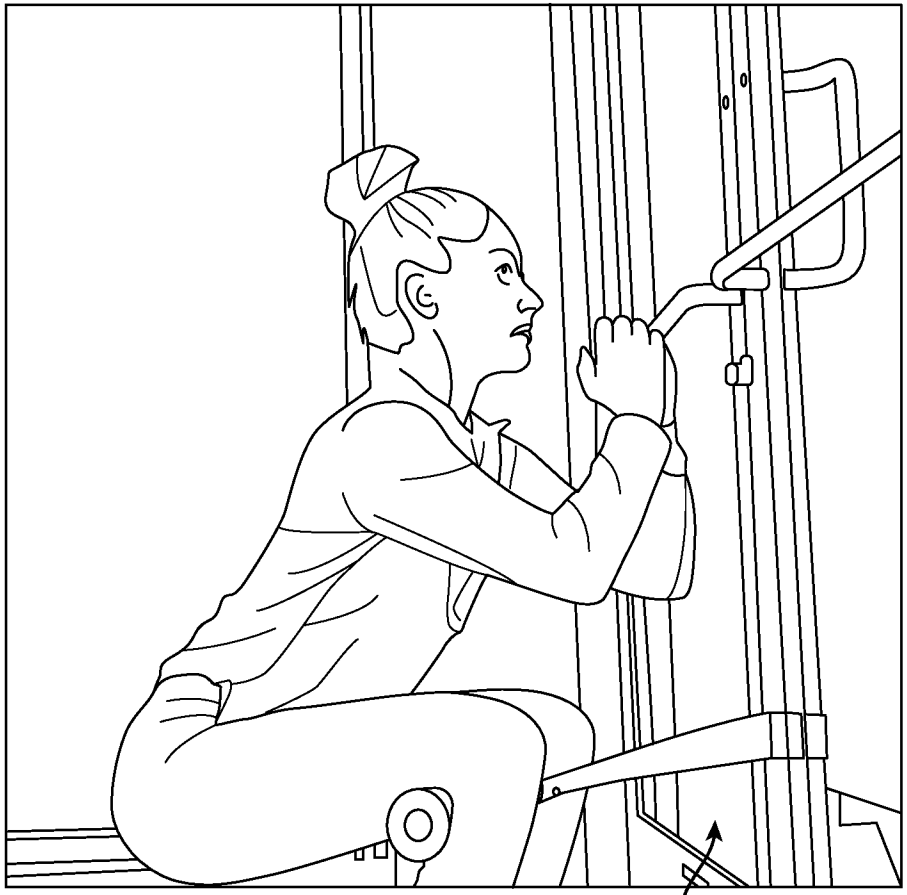
FIG. 7 illustrates aspects of a method for using an exercise system, according to embodiments of the present invention.

In some cases, a user may wish to use an exercise system 100 to perform sit-up repetitions, or sit-up variations (e.g. using a weighted ball or object) as shown in FIG. 5. In some cases, a user may wish to use an exercise system 100 to perform Russian Twist repetitions, or Russian Twist variations (e.g. using a weighted ball or object) as shown in FIG. 6. In some cases, a user may wish to use an exercise system 100 to perform squat repetitions as shown in FIG. 7 or squat variations (e.g. using a weighted ball or object) as shown in FIG. 8.

Figure 9:
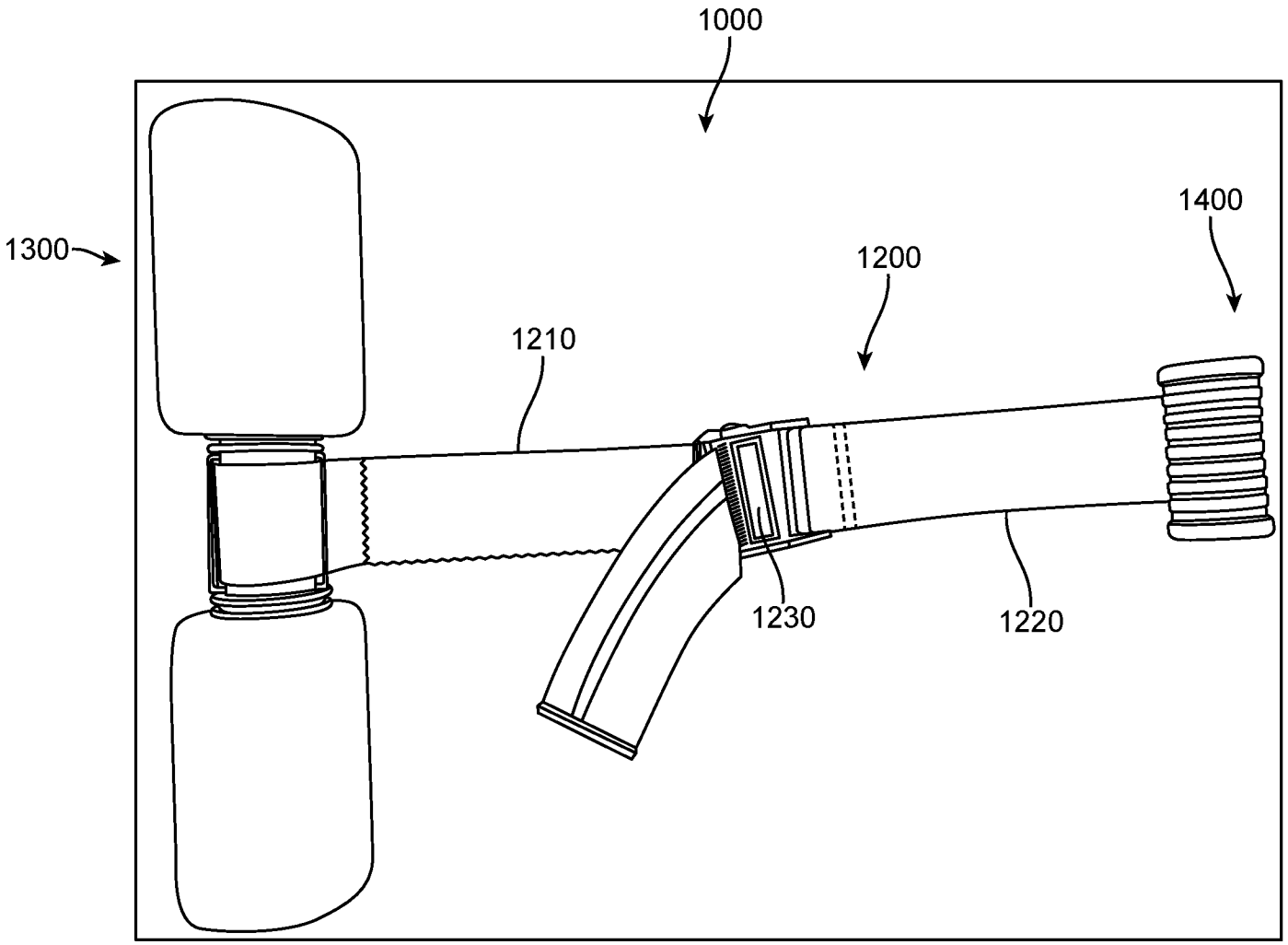
FIG. 9 illustrates aspects of an exercise system, according to embodiments of the present invention.
Figure 10:
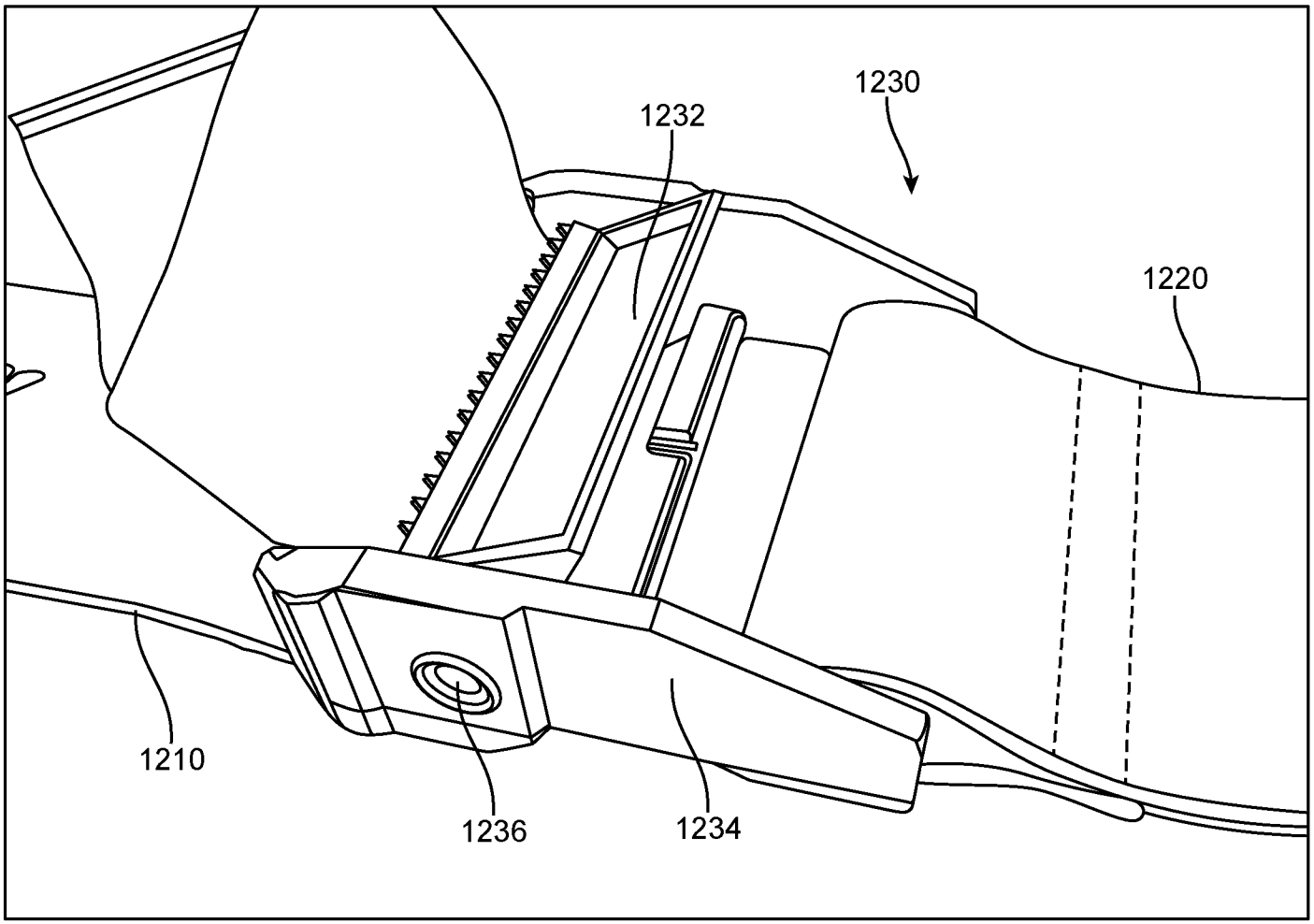
FIG. 10 illustrates aspects of an exercise system, according to embodiments of the present invention.

FIG. 9 depicts an exercise system 1000 according to embodiments of the present invention. As shown here, the exercise system 1000 includes a strap assembly 1200, a user engagement assembly 1300, and an anchor assembly 1400. The strap assembly 1200 includes a first strap 1210, a second strap 1220, and a strap coupling mechanism 1230 such as a cam buckle. By adjusting the coupling mechanism 1230, the user is able to change the effective working length of the first strap 1210 (and thereby change the distance between the user engagement assembly 1300 and the anchor assembly 1400). As shown in FIG. 10, the strap coupling mechanism 1230 can include a friction cam 1232 which can move relative to a frame 1234 via a pivot 1236. For example, the user can move the friction cam 1232 so as to allow the first strap 1210 to move freely relative to the frame 1234, and then allow the friction cam 1232 to return to its original position, thus fixing the first strap 1210 relative to the frame 1234.

Figure 11:
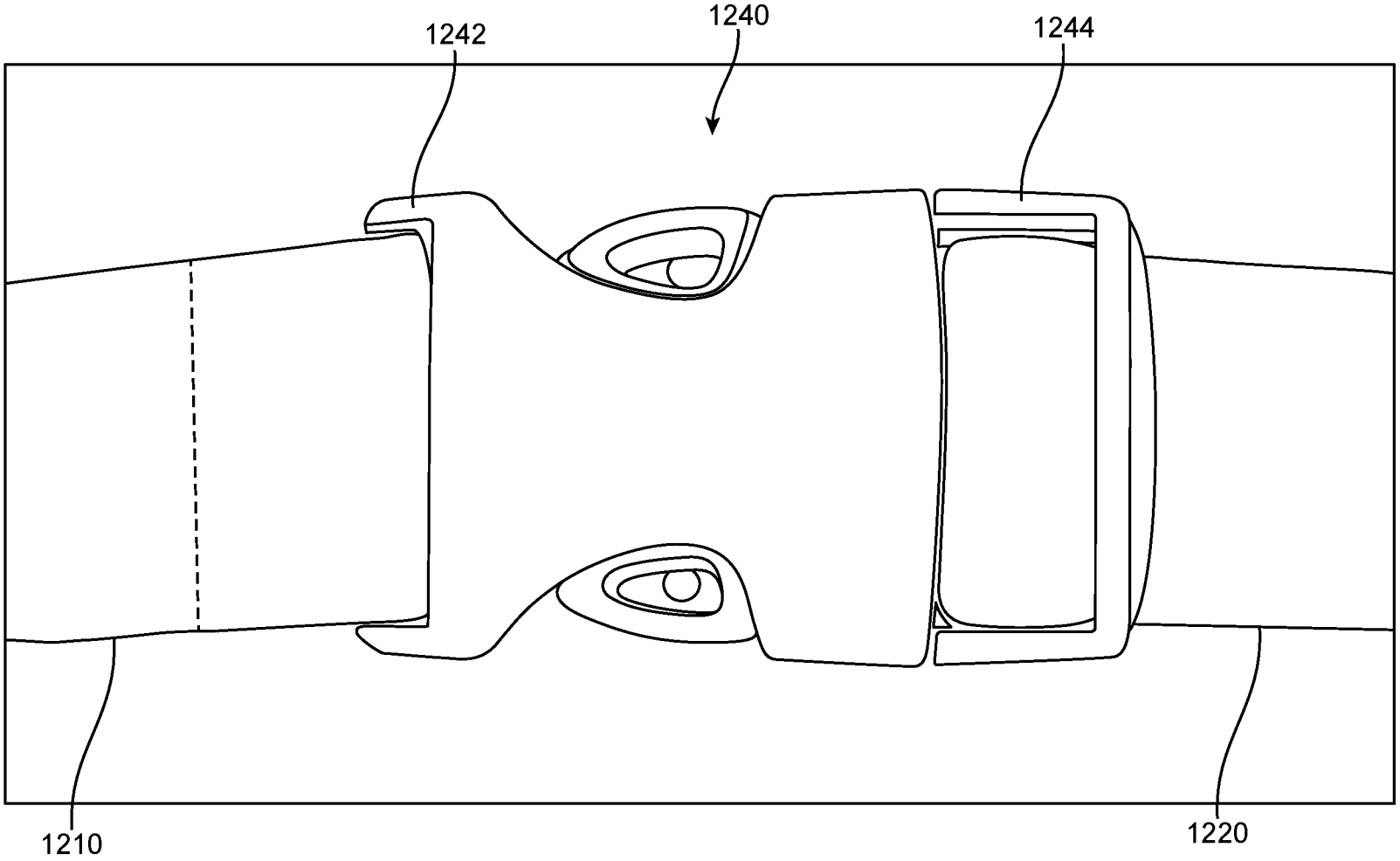
FIG. 11 illustrates aspects of an exercise system, according to embodiments of the present invention.

In some embodiments, a first strap 1210 and second strap 1220 can be coupled via a detachable coupling mechanism 1240, as shown in FIG. 11. In this embodiment, the coupling mechanism 1240 includes a first coupler 1242 and a second coupler 1244 that are completely detachable from one another. The first strap 1210 is coupled with the first coupler 1242 and the second strap 1220 is coupled with the second coupler 1244, and thus the first and second straps can be coupled together or completely uncoupled from one another. In some cases, the coupling mechanism 1240 can enable length adjustment in the effective working portion 1210 of the first strap and/or the second strap 1220.

Figure 12:
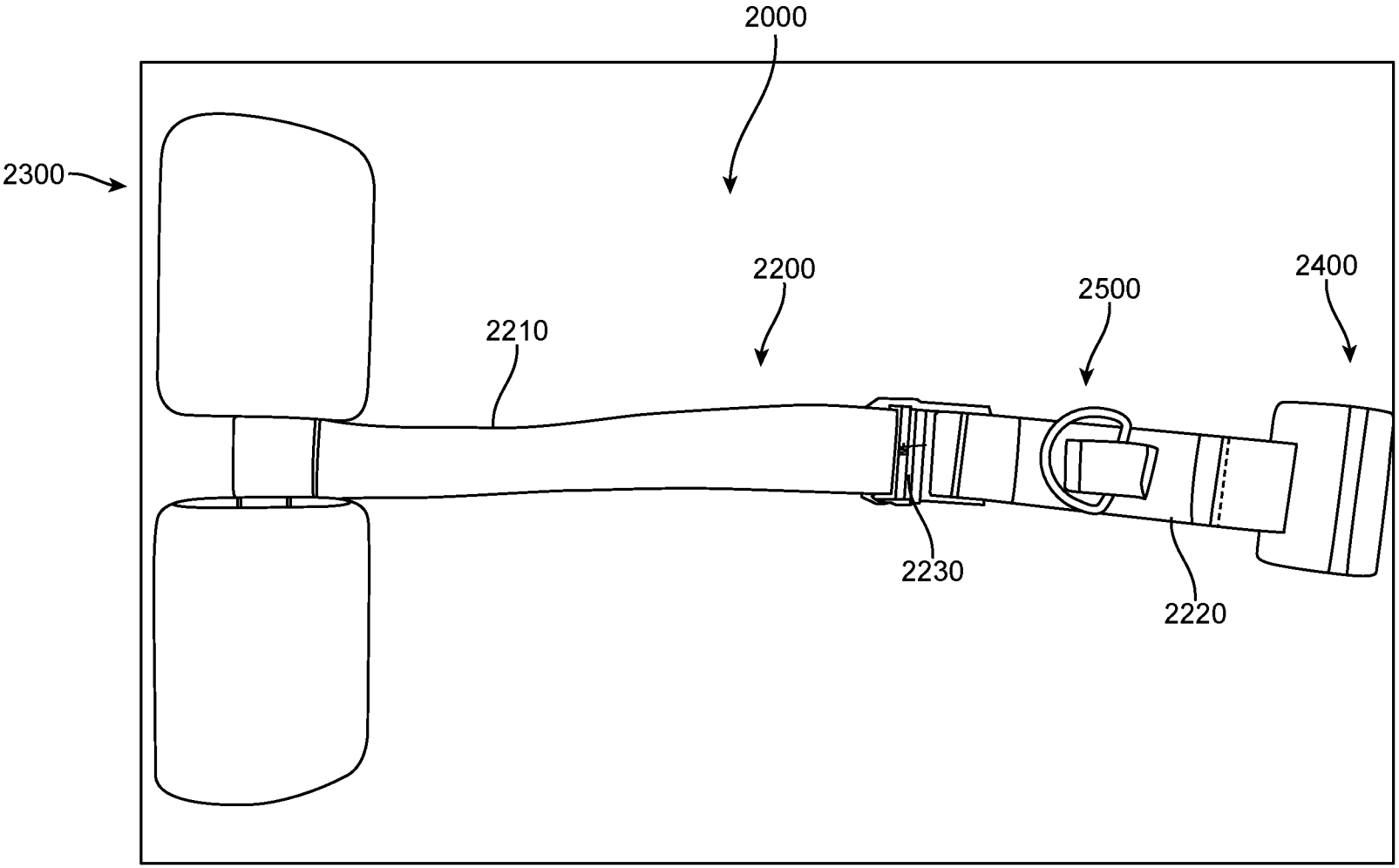
FIG. 12 illustrates aspects of an exercise system, according to embodiments of the present invention.

FIG. 12 depicts an exercise system 2000 according to embodiments of the present invention. As shown here, the exercise system 2000 includes a strap assembly 2200, a user engagement assembly 2300, and an anchor assembly 2400. The strap assembly 2200 includes a first strap 2210, a second strap 2220, and a strap coupling mechanism 2230 such as a cam buckle. By adjusting the coupling mechanism 2230, the user is able to change the effective working length of the first strap 2210 and thereby change the distance between the user engagement assembly 2300 and the anchor assembly 2400, or the distance between the user engagement assembly 2300 and the attachment assembly 2500.

Figure 13:
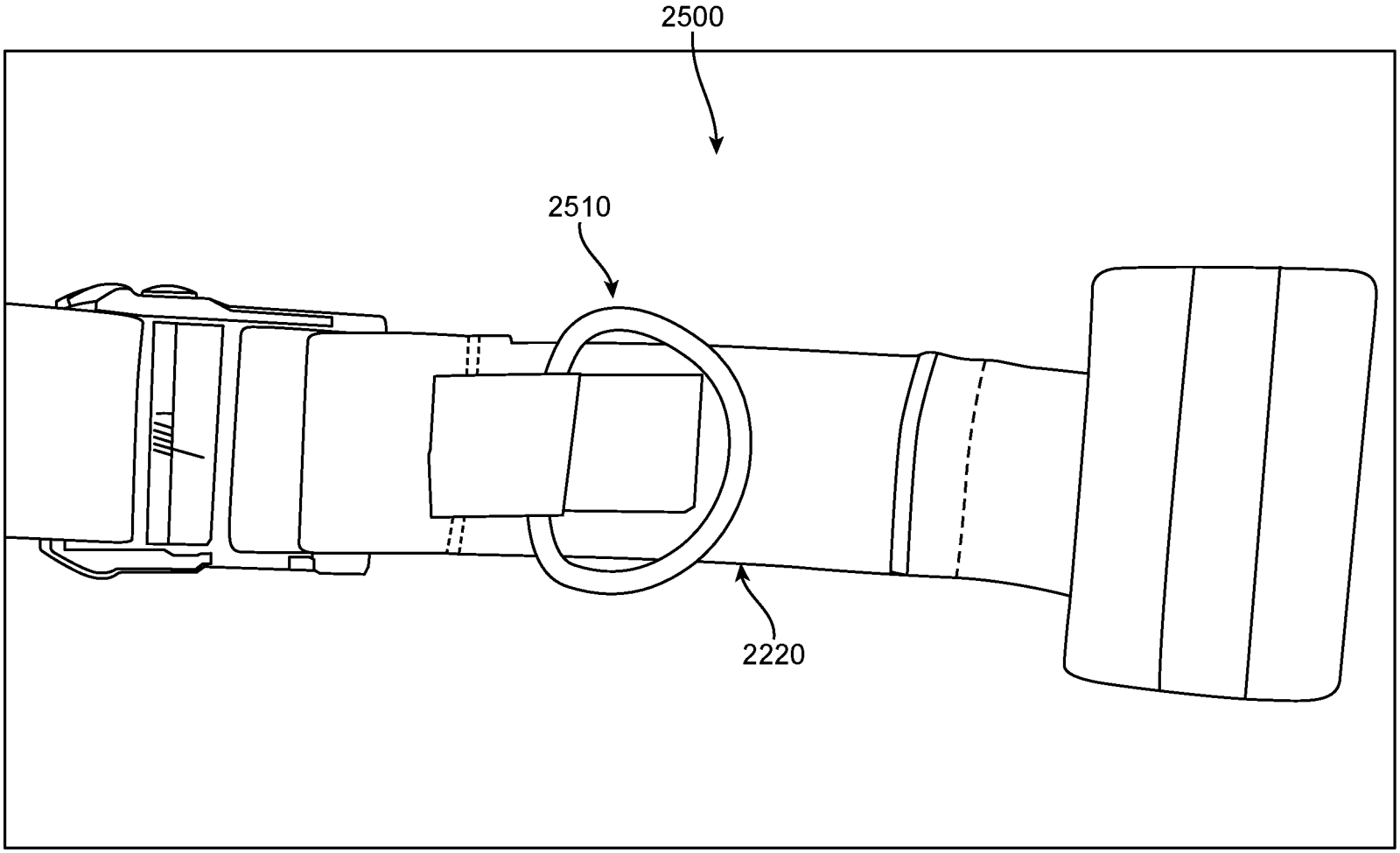
FIG. 13 illustrates aspects of an exercise system, according to embodiments of the present invention.

FIG. 13 depicts aspects of an attachment assembly 2500 according to embodiments of the present invention. As shown here, attachment assembly 2500 can include a loop or fixation mechanism 2510 attached with the second strap 2220. In use, the loop 2510 can be attached with an immovable object (e.g. a hook on a wall).

Figure 14:
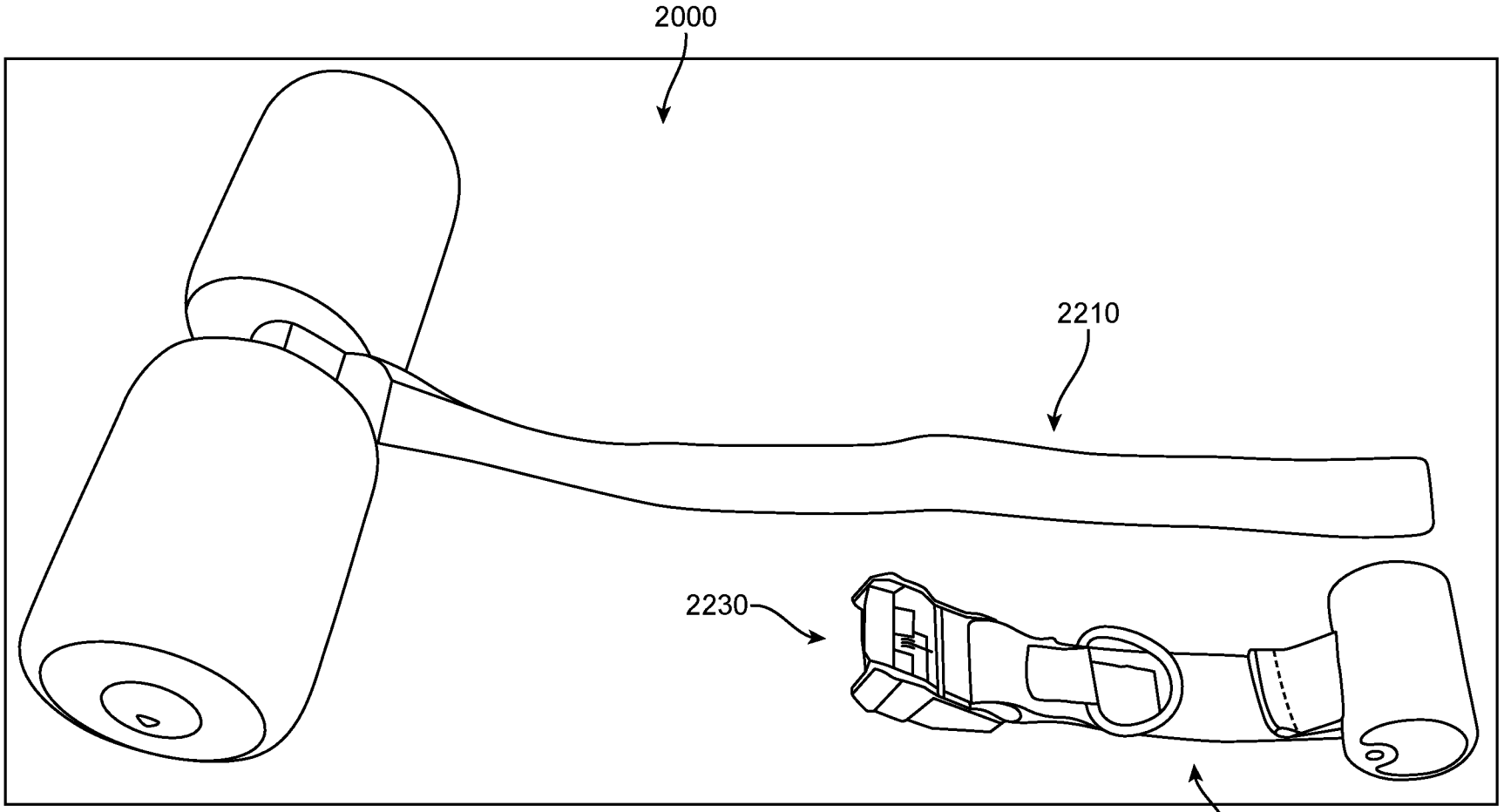
FIG. 14 illustrates aspects of an exercise system, according to embodiments of the present invention.

FIG. 14 depicts additional aspects of an exercise system 2000 according to embodiments of the present invention. As shown here, the exercise system 2000 includes a first strap 2210 and a second strap 2220, which can be releasably or reversibly coupled via a coupling mechanism 2230.

Figure 15:
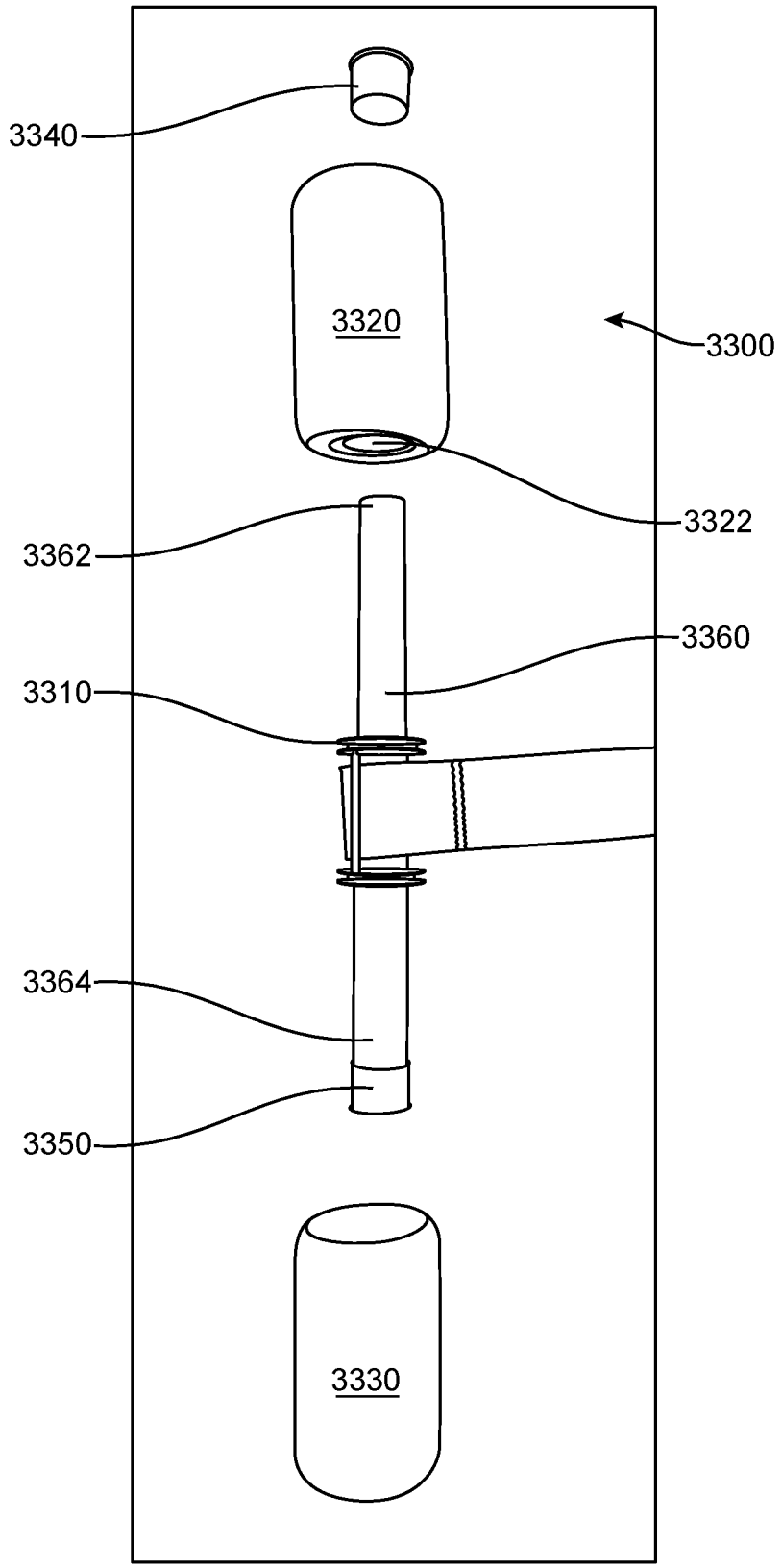
FIG. 15 illustrates aspects of an exercise system, according to embodiments of the present invention.

FIG. 15 provides a partially exploded view of a user engagement assembly 3300, according to embodiments of the present invention. As shown here, user engagement assembly 3300 includes a sleeve mechanism 3310, a first compressible pad 3320, a second compressible pad 3330, a first end cap 3340, a second end cap 3350, and a central elongate element 3360 such as a rod or a cylinder. The sleeve mechanism 3310 can include a central aperture which receives the central elongate element 3360 therethrough. The first end cap 3340 can be configured to engage a first end 3362 of the elongate element 3360 and the second end cap 3350 can be configured to engage a second end 3364 of the elongate element 3360. The compressible pads 3320, 3330 can each have central apertures (e.g. 3322) configured to receive respective end portions of the elongate element 3360.

Figure 16:
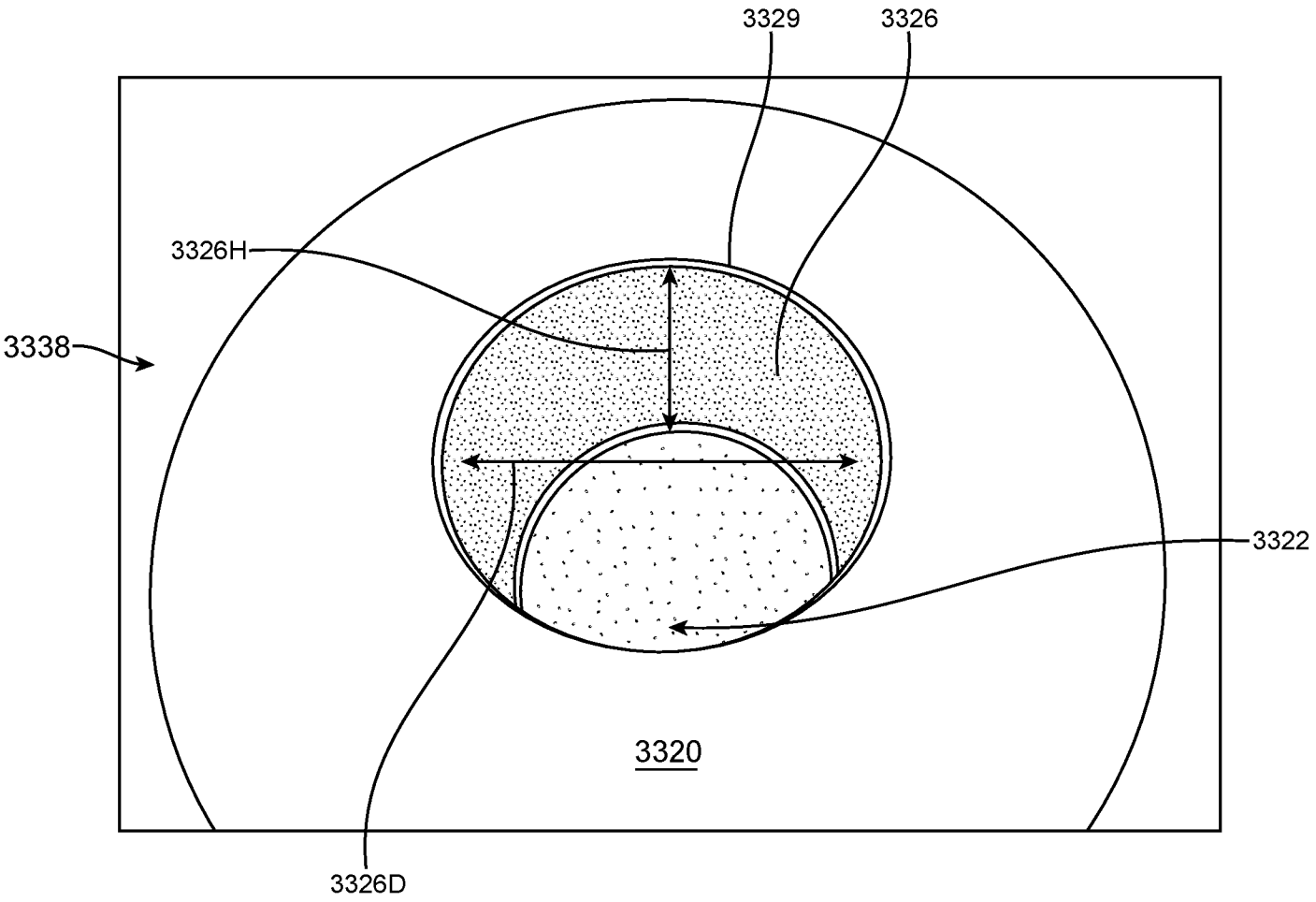
FIG. 16 illustrates aspects of an exercise system, according to embodiments of the present invention.

FIG. 16 depicts additional aspects of compressible pad 3320, and it is understood that compressible pad 3330 (e.g. as shown in FIG. 15) can include similar elements. As illustrated here, compressible pad 3320 includes a central aperture 3322, and a lateral section 3338 of compressible pad 3320 includes a recessed portion 3326 (e.g. annular recess). A diameter 3326D of the recessed portion 3326 can be sized to match a diameter of an end cap (not shown). A height 3326H of the recessed portion 3326 can be sized to match a height of a stem of an end cap (not shown). Relatedly, the compressible pad 3320 includes a lateral internal groove 3329 that is configured to receive a cover of an end cap.

Figure 17:
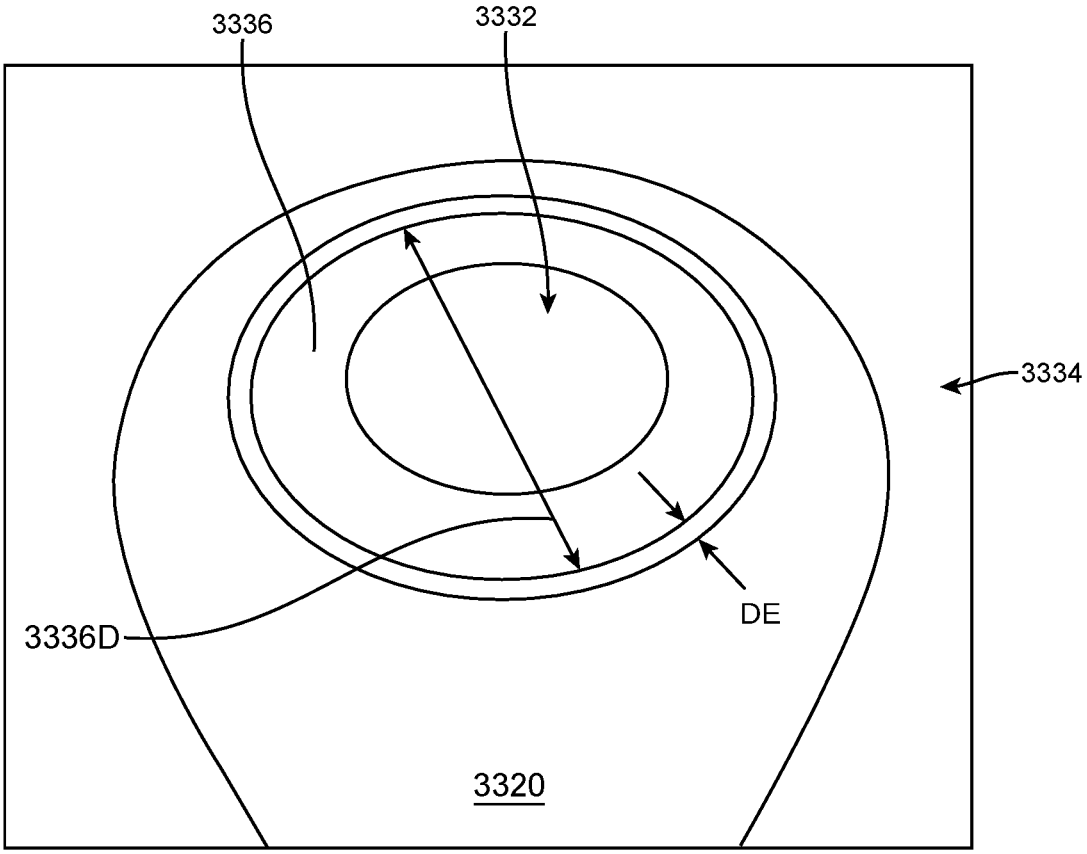
FIG. 17 illustrates aspects of an exercise system, according to embodiments of the present invention.

FIG. 17 depicts additional aspects of compressible pad 3330, and it is understood that compressible pad 3320 (e.g. as shown in FIG. 15) can include similar elements. As illustrated here, compressible pad 3330 includes a central aperture 3332, and a medial section 3334 of compressible pad 3330 includes a recessed portion 3336 (e.g. annular recess). A diameter 3336D of the recessed portion 3336 can be sized to match a diameter of a lateral rib of a sleeve mechanism (not shown). In this way, the lateral rib of the sleeve mechanisms can fittingly engage the recessed portion 3336 of the compressible pad. For example, a medial end portion or section 3334 of the first compressible pad includes an annular recess 3336 having a diameter 3336D that is equal to a diameter of a lateral rib of a sleeve mechanism. As shown here, annular recess 3336 has a depth DE. In some cases, the depth DE is equivalent to a thickness of the lateral rib.

Figure 18:
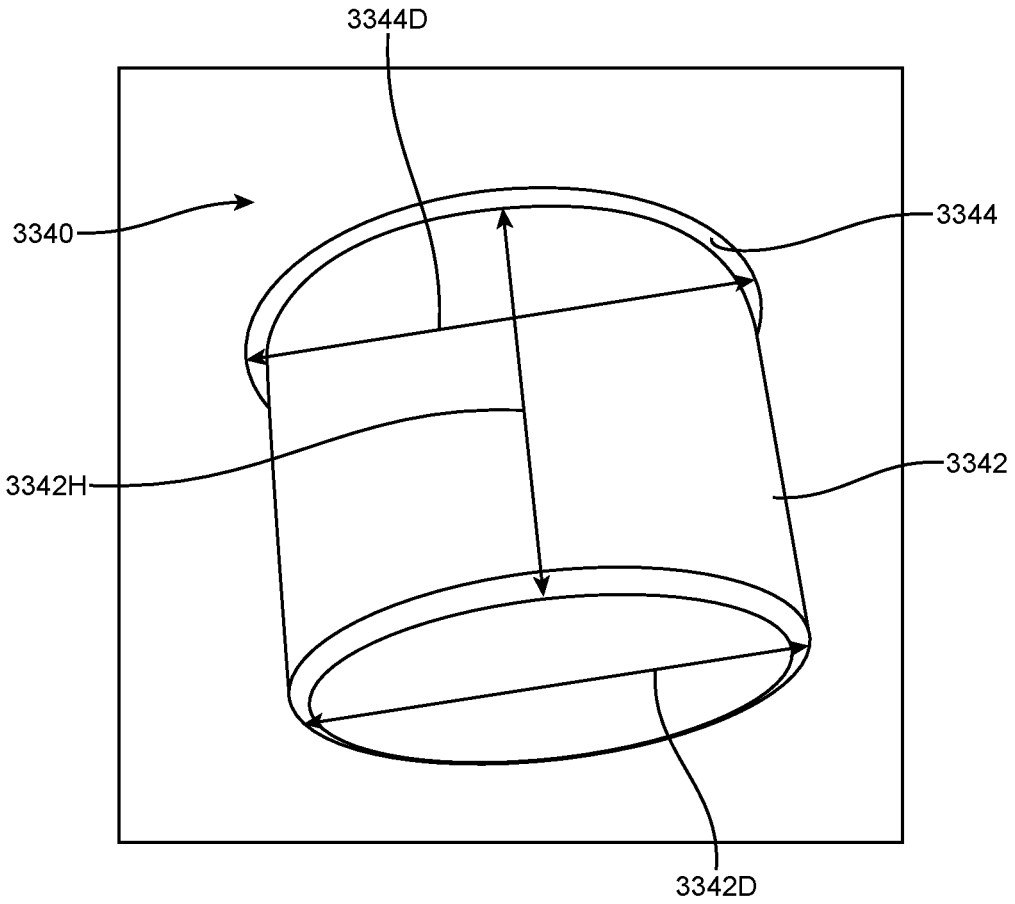
FIG. 18 illustrates aspects of an exercise system, according to embodiments of the present invention.

FIG. 18 depicts additional aspects of an end cap 3340, and it is understood that end cap 3350 (e.g. as shown in FIG. 15) can include similar elements. As illustrated here, end cap 3340 includes a stem 3342 and a cover 3344. The stem 3342 can have a height 3342H that matches the height 3326H of the recessed portion 3326 depicted in FIG. 16. The stem 3342 can have an outer diameter 3342D that matches the diameter 3326D of the recessed portion 3326 depicted in FIG. 16. The cover 3344 can have a diameter 3344D that matches the diameter of the groove 3329 of the compressible pad 3320 depicted in FIG. 16.

Hence, as illustrated in FIGS. 12 to 18, a system can include a cam buckle, which enables the user to adjust the device after is has been engaged with the door or otherwise anchored in place. This feature can enable quick and/or easy adjustment. For example, the user can slide the strap under the door, and then adjust the strap. As shown in FIGS. 15 and 16, a strap can include a D-loop, which is attached to the strap between the cam buckle and the door anchor. The D-loop enables the user to attach the strap to any fixed object, without having to use the door anchor.

Although embodiments of the present invention have been explained in relation to one or more preferred embodiments, it is to be understood that many other possible modifications and variations can be made without departing from the spirit and scope of the invention.

All features of the described systems and devices are applicable to the described methods mutatis mutandis, and vice versa. Embodiments of the present invention encompass kits having exercise systems as disclosed herein. In some embodiments, the kit includes one or more exercise systems, along with instructions for using the system for example according to any of the methods disclosed herein.

Although the foregoing invention has been described in some detail by way of illustration and example for purposes of clarity of understanding, one of skill in the art will appreciate that certain changes, modifications, alternate constructions, and/or equivalents may be practiced or employed as desired, and within the scope of the appended claims. In addition, each reference provided herein are incorporated by reference in its entirety to the same extent as if each reference were individually incorporated by reference. Relatedly, all publications, patents, patent applications, journal articles, books, technical references, and the like mentioned in this specification are herein incorporated by reference to the same extent as if each individual publication, patent, patent application, journal article, book, technical reference, or the like was specifically and individually indicated to be incorporated by reference.

What is claimed is:

1. An exercise system, comprising:

a user engagement assembly having a central elongate element, a first compressible pad, a second compressible pad, and a sleeve mechanism;

an anchor assembly; and a strap assembly having a first end portion engaged with the sleeve mechanism and a second end portion engaged with the anchor assembly, wherein the central elongate element comprises a first portion and a second portion, wherein the sleeve mechanism comprises (i) a first end portion having a first lateral rib, a first medial rib, and a first groove between the first lateral rib and the first medial rib, (ii) a second end portion having a second lateral rib, a second medial rib, and a second groove between the second lateral rib and the second medial rib, (iii) a central column disposed between the first medial rib and the second medial rib, and (iv) a strap band extending between the first medial rib and the second medial rib, wherein the strap band, the central column, the first medial rib, and the second medial rib in combination define a slit that receives a strap of the strap assembly therethrough, wherein the first compressible pad is engaged with the first portion of the central elongate element and the second compressible pad is engaged with the second portion of the central elongate element, wherein a medial end portion of the first compressible pad comprises an annular recess having a diameter that is equal to a diameter of the first lateral rib of the sleeve mechanism, and wherein a medial end portion of the second compressible pad comprises an annular recess having a diameter that is equal to a diameter of the second lateral rib of the sleeve mechanism.

2. The exercise system according to claim 1, wherein the user engagement assembly further comprises a first end cap and a second end cap, wherein the first end cap is engaged with a first end of the central elongate element and the second end cap is engaged with a second end of the central elongate element, wherein a lateral end portion of the first compressible pad comprises a recessed portion having a height, wherein the first end cap comprises a stem having a height, and wherein the height of the recessed portion of the first compressible pad is equal to the height of the stem of the first end cap.

3. The exercise system according to claim 1, wherein the user engagement assembly further comprises a first end cap, wherein the first end cap is engaged with a first end of the central elongate element, wherein a lateral end portion of the first compressible pad comprises a lateral internal groove, and wherein an outer periphery of a cover of the first cap is nestled in the lateral internal groove of the first compressible pad.

4. The exercise system according to claim 1, wherein a depth of the annular recess of the medial end portion of the first compressible pad is equivalent to a thickness of the first lateral rib of the first end portion of the sleeve mechanism.

5. The exercise system according to claim 4, wherein a depth of the annular recess of the medial end portion of the second compressible pad is equivalent to a thickness of the second lateral rib of the second end portion of the sleeve mechanism.

* * * * *